US006231412B1

(12) United States Patent
Kawade et al.

(10) Patent No.: US 6,231,412 B1
(45) **Date of Patent: *May 15, 2001**

(54) METHOD OF MANUFACTURING AND ADJUSTING ELECTRON SOURCE ARRAY

(75) Inventors: Hisaaki Kawade, Yokohama; Tatsuya Iwasaki, Atsugi, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/718,744

(22) Filed: Sep. 18, 1996

(51) Int. Cl.[7] ..... H01J 9/02; H01J 9/42
(52) U.S. Cl. ..... 445/3; 445/6; 445/51
(58) Field of Search ..... 445/3, 51, 6

(56) References Cited

U.S. PATENT DOCUMENTS

| | | | | |
|---|---|---|---|---|
| 5,066,883 | | 11/1991 | Yoshioka et al. | 313/309 |
| 5,129,850 | * | 7/1992 | Kane et al. | 445/24 |
| 5,141,460 | * | 8/1992 | Jaskie et al. | 445/24 |
| 5,530,314 | * | 6/1996 | Banno et al. | 313/310 |
| 5,591,061 | * | 1/1997 | Ikeda et al. | 445/3 |
| 5,593,335 | * | 1/1997 | Suzuki et al. | 445/51 X |
| 5,597,338 | * | 1/1997 | Iwai et al. | 445/51 |
| 5,605,483 | * | 2/1997 | Takeda et al. | 445/3 |
| 5,853,310 | * | 12/1998 | Nishimura et al. | 445/24 |

FOREIGN PATENT DOCUMENTS

| | | |
|---|---|---|
| 0692809A2 | 1/1996 | (EP) . |
| 6431332 | 2/1989 | (JP) . |
| 1-257552 | 10/1989 | (JP) . |
| 1-283749 | 11/1989 | (JP) . |
| 4-249827 | 9/1992 | (JP) . |
| 8-96700 | 4/1996 | (JP) . |

OTHER PUBLICATIONS

G. Dittmer, "Electrical Conduction and Electron Emission of Discontinuous Thin Films," Thin Solid Films, 9 (1972) pp. 317–328.

M. Elinson et al., "The Emission of Hot Electrons and The Field Emission of Electrons From Tin Oxide," Eng. Electron Phys., Jul. 1965, pp. 1290–1296.

M. Hartwell et al., "Strong Electron Emission From Patterned Tin–Indium Oxide Thin Films", IEDM Technical Digest 1975, pp. 519–521.

H. Araki et al., "Electroforming and Electron Emission of Carbon Thin Films," Journal of the Vacuum Society of Japan, vol. 26, No. 1, pp. 22–29.

C. Spindt, "Physical Properties of Thin Film Field Emission Cathodes with Molybdenum Cones," J. Appl. Phys., vol. 47, No. 12, Dec. 1976 pp. 5248–5263.

C. Mead, "Operation of Tunnel–Emission Devices," J. Appl. Phys., vol. 32, No. 4, Apr. 1961, pp. 646–652.

W. Dyke et al., "Field Emission," Advances in Electronics and Electron Physics, vol. VIII, Academic Press Inc. 1956, pp. 90–185.

* cited by examiner

*Primary Examiner*—Kenneth J. Ramsey
(74) *Attorney, Agent, or Firm*—Fitzpatrick, Cella, Harper & Scinto

(57) ABSTRACT

In an electron source having a plurality of surfaceconduction electron-emitting devices, the electrical characteristics of the surfaceconduction electron-emitting devices are made, controllable, and uniform. For this purpose, the electron emission characteristic of a selected surfaceconduction electron-emitting device is adjusted with a correction process of applying a voltage higher than a practical driving voltage to the device.

83 Claims, 18 Drawing Sheets

METHOD OF MANUFACTURING AND ADJUSTING ELECTRON SOURCE ARRAY

BACKGROUND OF THE INVENTION

The present invention relates to an electron source using a plurality of surfaceconduction electron-emitting devices, an image forming apparatus such as a display apparatus or an exposure apparatus using the electron source, and a method of manufacturing and adjusting the electron source.

Two types of electron sources, namely thermionic sources and cold cathode electron sources, are conventionally known as electron-emitting devices. Examples of cold cathode electron sources are electron-emitting devices of the field emission type (to be abbreviated to "FE" hereinafter), metal/insulator/metal type (to be abbreviated to "MIM" hereinafter), and surfaceconduction emission type.

Known examples of the FE type are described by W. P. Dyke and W. W. Dolan, "Field emission", Advance in Electron Physics, 8,89 (1956) and by C. A. Spindt, "Physical properties of thin-film field emission cathodes with molybdenum cones", J. Appl. Phys., 47,5248 (1976).

A known example of the MIM type is described by C. A. Mead, "Operation of Tunnel-Emission Devices", J. Appl. Phys., 32,646 (1961).

A known example of the surfaceconduction electron-emitting device is described by M. I. Elinson, Radio. Eng. Electron Phys., 10 (1965).

The surfaceconduction electron-emitting device makes use of a phenomenon in which electron emission is produced in a thin conductive film formed on an insulating substrate by passing a current parallel to the film surface. Various examples of this surfaceconduction electron-emitting device have been reported. One relies upon a thin film of $SnO_2$ according to Elinson, mentioned above. Other examples use a thin film of Au [G. Dittmer, "Thin Solid Films", 9,317 (1972)]; a thin film of $In_2O_3/SnO_2$ [M. Hartwell and C. G. Fonstad, "IEEE Trans. E.D. Conf.", 519 (1975)]; and a thin film of carbon [Hisashi Araki, et al: "Vacuum", Vol. 26, No. 1, p. 22 (1983)].

A typical construction example of the surfaceconduction electron-emitting device is of the type according to M. Hartwell above, in which an electron emission portion is formed by an electrification process called "energization forming" on a thin conductive film of a metal oxide or the like, which formed between a pair of device electrodes on an insulating substrate. A spacing between the device electrodes of the surfaceconduction electron-emitting device is set to 0.5 to 1 mm. The width of the device electrode is set to 0.1 mm.

In these surfaceconduction electron-emitting devices, generally, the electron emission portion is formed on the thin conductive film by the electrification process called "energization forming" before electron emission is performed. According to this energization forming process, a DC voltage or a very slowly rising voltage on the order of, e.g., 1 V/min is impressed across the thin conductive film, thereby locally destroying or deforming the thin conductive film, or changing its properties to change the construction. With this process, the electron emission portion having a high electrical resistance is formed. When a voltage is applied to the thin conductive film to form the electron emission portion, fissures are formed in the conductive film, and electrons are emitted from the vicinity of the fissures.

Since the surfaceconduction electron-emitting device is simple in structure and easy to manufacture, an advantage is that a large number of devices can be arrayed over a large surface area. Accordingly, a variety of applications that exploit this feature have been studied. For example, an application to an image forming apparatus such as a display apparatus has been made.

As a conventional example of an apparatus in which a number of surfaceconduction electron-emitting devices are formed on an array, mention can be made of an electron source in which surfaceconduction electron-emitting devices are arrayed in parallel, and both ends (double device electrodes) of the individual devices are connected by a wiring layer (also referred to as a common wiring layer) to obtain a row, a number of which are provided in an array (also referred to as a "ladder-shaped" array), (Japanese Patent Laid-Open Nos. 1-31332, 1-283749, and 1-257552). Particularly, for a display apparatus, a flat-type display apparatus which emits its own light without requiring backlighting has been proposed, which comprises a combination of an electron source having a large number of surfaceconduction electron-emitting devices and phosphors that produce visible light from the electron source upon irradiation of an electron beam (U.S. Pat. No. 5,066,883).

However, the conventional electron source using the surfaceconduction electron-emitting devices has the following problems.

When a large number of surfaceconduction electron-emitting devices are to be formed on a substrate, the shape or material composition may vary in units of devices, resulting in non-uniform electron emission characteristics of the manufactured devices.

For example, when the deposition conditions or patterning conditions in a process of forming an electrode or a thin conductive film vary, the characteristics of the manufactured devices may vary in units of substrates. Even in the same substrate, the characteristics may change in units of devices.

Similarly, when electrification conditions in the energization forming process vary in units of devices, the electron emission characteristics may change.

A distribution tends to be formed in the energization forming voltage due to the variation in resistance of the thin film, or a voltage drop caused by the resistance of wiring for connecting a large number of surfaceconduction electron-emitting devices, so the surfaceconduction electron-emitting devices can hardly be subjected to the energization forming process under the same conditions. The resistance values or electron emission characteristics of the surfaceconduction electron-emitting devices after energization forming vary accordingly. When the applied voltage-to-emission current characteristics vary, the emission electron amount (or the light emission luminance in a display apparatus) varies in units of surfaceconduction electron-emitting devices, resulting in a luminance variation of the display apparatus.

As described above, the electron emission characteristics of the surfaceconduction electron-emitting device often vary due to various factors generated in the film-forming process, the patterning process, the energization forming process, or the electrification activation process of the manufacturing processes of the electron source. Conventionally, if the electron emission characteristics of a manufactured surfaceconduction electron-emitting device vary beyond the required allowance for the application purpose, the electron source is discarded as a defective product, or a driving correction circuit for correcting the variation in characteristics is added to make use of the electron source. The former lowers the manufacturing yield rate to result in an increase in cost, and the latter results in an increase in cost and a bulky apparatus because of the additional correction circuit.

Therefore, in the electron source using a plurality of surfaceconduction electron-emitting devices, the electrical characteristics of the respective surfaceconduction electron-emitting devices are required to be uniform and easy to control.

SUMMARY OF THE INVENTION

The present invention has been made in consideration of the above conventional problem, and has as its object to provide an electron source using a plurality of surfaceconduction electron-emitting devices which have uniform and easily controllable electrical characteristics, an image forming apparatus for which luminance adjustment can be easily performed, and a method of manufacturing and adjusting the electron source.

In order to achieve the above object, the present inventor has invented, as a result of extensive studies and experiments, an electron source comprising a vacuum vessel, and a plurality of surfaceconduction electron-emitting devices arranged in the vacuum vessel, wherein the vacuum vessel is evacuated such that a partial pressure of an organic substance is not more than $1\times10^{-7}$ Torr, and a characteristic correction voltage pulse is applied in advance to at least one of the plurality of surfaceconduction electron-emitting devices such that (emission current Ie vs. applied device voltage Vf) characteristics of the plurality of surfaceconduction electron-emitting devices are uniform.

Preferably, the characteristic correction voltage pulse has a peak value larger than that of a driving voltage pulse applied in practical use of the electron source.

Preferably, the characteristic correction voltage pulse has a pulse width larger than that of a driving voltage pulse applied in practical use of the electron source.

Preferably, the plurality of surfaceconduction electron-emitting devices are connected by row and column wiring layers in a matrix arrangement.

Preferably, the plurality of surfaceconduction electron-emitting devices are electrically parallelly connected to each other.

The present invention also incorporates an image forming apparatus. The image forming apparatus of the present invention comprises the above-described electron source, modulating means for modulating an electron beam emitted from the electron source on the basis of image information, and an image forming member for forming an image upon irradiation of the electron beam.

The present invention also incorporates a method of manufacturing an electron source. According to the present invention, there is provided a method of manufacturing an electron source having a plurality of surfaceconduction electron-emitting devices, comprising the step of forming a plurality of device electrode pairs on a substrate, the step of forming a conductive thin film between device electrodes of each of the plurality of device electrode pairs, the energization forming step of forming an electron emission portion on part of the conductive thin film by applying a voltage across the device electrode pair, the evacuation step of lowering a partial pressure of an organic substance in a vacuum atmosphere to be not more than $1\times10^{-7}$ Torr, and the step of applying a characteristic correction voltage pulse across an arbitrary device electrode pair such that (emission current Ie vs. applied device voltage Vf) characteristics of the plurality of surfaceconduction electron-emitting devices are uniform.

Preferably, the step of applying the characteristic correction voltage pulse includes the step of matching the (emission current Ie vs. applied device voltage Vf) characteristics of the devices with a reference corresponding to the (emission current Ie vs. applied device voltage Vf) characteristic of one of the plurality of surfaceconduction electron-emitting devices which exhibits a highest electron emission threshold voltage Vth.

Preferably, the method further comprises, between the energization forming step and the evacuation step, the electrification activation step of depositing carbon in a periphery of the electron emission portion formed in the energization forming step.

Preferably, the characteristic correction voltage pulse has a peak value larger than that of a driving voltage pulse applied in practical use of the electron source.

Preferably, the characteristic correction voltage pulse has a pulse width larger than that of a driving voltage pulse applied in practical use of the electron source.

Preferably, the step of applying the characteristic correction voltage pulse includes the step of changing an electron emission threshold voltage Vth of one of the surfaceconduction electron-emitting devices, to which the pulse is applied, to a value larger than that before application of the pulse.

Preferably, the method further comprises, before the step of applying the characteristic correction voltage pulse, the measurement step of measuring variations in electron emission characteristics of the plurality of surfaceconduction electron-emitting devices.

Preferably, the measurement step includes the step of applying, to a device, a voltage pulse having a peak value equal to a maximum peak value of a driving voltage pulse applied in practical use of the electron source, thereby measuring the emission current Ie.

Preferably, the measurement step includes the step of applying, to a device, a voltage pulse having a pulse width equal to a maximum pulse width of a driving voltage pulse applied in practical use of the electron source, thereby measuring the emission current Ie.

The present invention also incorporates a method of adjusting an electron source. According to the present invention, there is provided a method of adjusting an electron source having a plurality of surfaceconduction electron-emitting devices, comprising the adjustment step of matching (emission current Ie vs. applied device voltage Vf) characteristics of the devices with a reference corresponding to the (emission current Ie vs. applied device voltage Vf) characteristic of one of the plurality of surfaceconduction electron-emitting devices which exhibits a highest electron emission threshold voltage Vth.

Preferably, the adjustment step of matching the (emission current Ie vs. applied device voltage Vf) characteristics of the surfaceconduction electron-emitting devices with the reference includes the step of applying a characteristic correction pulse to the surfaceconduction electron-emitting devices in a vacuum atmosphere in which a partial pressure of an organic substance is lowered to be not more than $1\times10^{-7}$ Torr, thereby correcting the (emission current Ie vs. applied device voltage Vf) characteristics.

The present invention also incorporates another method of adjusting an electron source. According to the present invention, there is provided a method of adjusting an electron source having a plurality of surfaceconduction electron-emitting devices, comprising the step of applying a characteristic correction voltage pulse across an arbitrary device electrode pair in a vacuum atmosphere in which a partial pressure of an organic substance is not more than $1\times10^{-7}$ Torr such that (emission current Ie vs. applied device voltage Vf) characteristics of the surfaceconduction electron-emitting devices are uniform.

Preferably, the characteristic correction voltage pulse has a peak value larger than that of a driving voltage pulse applied in practical use of the electron source.

Preferably, the characteristic correction voltage pulse has a pulse width larger than that of a driving voltage pulse applied in practical use of the electron source.

Preferably, the step of applying the characteristic correction voltage pulse includes the step of changing an electron emission threshold voltage Vth of one of the surfaceconduction electron-emitting devices, to which the pulse is applied, to a value larger than that before application of the pulse.

Preferably, the method further comprises, before the step of applying the characteristic correction voltage pulse, the measurement step of measuring variations in electron emission characteristics of the plurality of surfaceconduction electron-emitting devices.

Preferably, the measurement step includes the step of applying, to a device, a voltage pulse having a peak value equal to a maximum peak value of a driving voltage pulse applied in practical use of the electron source, thereby measuring the emission current Ie.

Preferably, the measurement step includes the step of applying, to a device, a voltage pulse having a pulse width equal to a maximum pulse width of a driving voltage pulse applied in practical use of the electron source, thereby measuring the emission current Ie.

The present invention also incorporates another method of manufacturing an electron source. According to the present invention, there is provided a method of manufacturing an electron source having a plurality of surfaceconduction electron-emitting devices, comprising the step of forming a plurality of device electrode pairs on a substrate, the step of forming a conductive thin film between device electrodes of each of the plurality of device electrode pairs, the energization forming step of forming an electron emission portion on part of the conductive thin film by applying a voltage across the device electrode pair, and the step of matching (emission current Ie vs. applied device voltage Vf) characteristics of the devices with a reference corresponding to the (emission current Ie vs. applied device voltage Vf) characteristic of one of the plurality of surfaceconduction electron-emitting devices which exhibits a highest electron emission threshold voltage Vth.

According to the manufacturing and adjusting methods of the present invention, the uniformity in electron emission characteristics of a plurality of surfaceconduction electron-emitting devices can be ensured by a very simple correction process.

Even when factors for varying the electron emission characteristics are generated in various ones of the manufacturing processes of the electron source, i.e., the film-forming process, the patterning process, the energization forming process, and the electrification activation process, the electron emission characteristics of a number of devices can be made uniform by performing the correction process of the present invention.

Even electron sources which are conventionally to be discarded as defective products because of poor uniformity can also be put in use after the correction process of the present invention, resulting in an increase in manufacturing yield rate.

Since the electron source of the present invention has a very high uniformity, the conventional additional driving correction circuit is no longer necessary. As a result, the apparatus can be made more compact, and cost reduction can be achieved.

The image forming apparatus of the present invention has a highly uniform luminance, so that the image quality is high.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

As described above, the present invention relates to a new electron source using a plurality of surfaceconduction electron-emitting devices, an image forming apparatus using the electron source, and methods of manufacturing the electron source and the image forming apparatus. The construction and function of each embodiment will be described below in more detail together with preferred examples of the surfaceconduction electron-emitting device.

There are plane and step type surfaceconduction electron-emitting devices, and surfaceconduction electron-emitting devices of any type can be used in the present invention. The basic structure of a plane type surfaceconduction electron-emitting device will be described first.

Figure 1A:
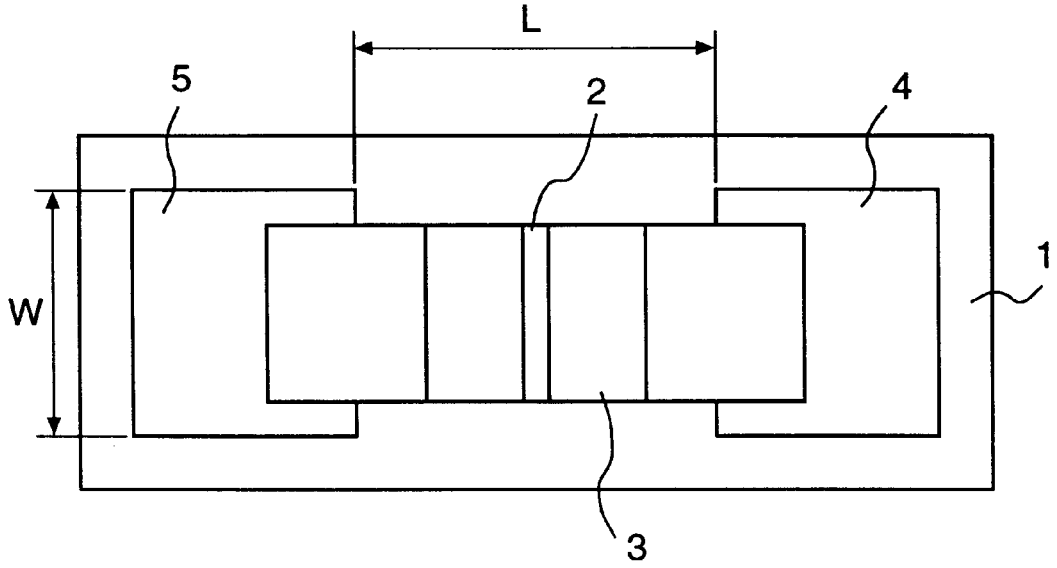
FIGS. 1A and 1B are plan and cross-cross-sectional views schematically showing the structure of a plane type surface-conduction electron-emitting device used in the present invention.
Figure 1B:
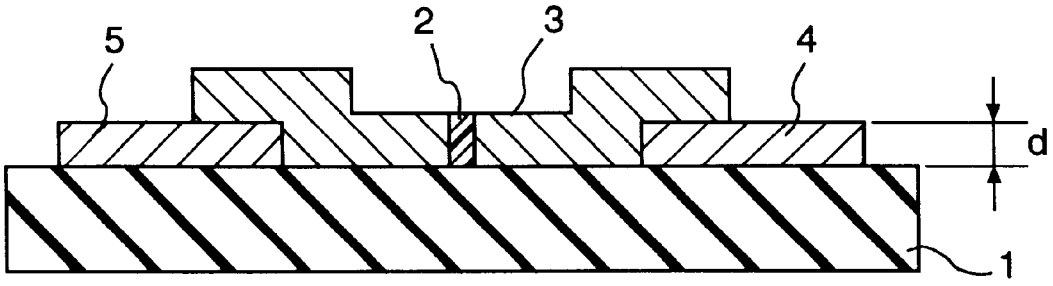

FIGS. 1A and 1B are plane and cross-cross-sectional views showing the basic structure of the plane type surfaceconduction electron-emitting device.

Referring to FIGS. 1A and 1B, reference numeral 1 denotes a substrate; 2, an electron emission portion; 3, a thin conductive film; and 4 and 5, device electrodes.

Silica glass, glass having a reduced impurity content as of Na, soda-lime glass, a layered structure obtained by depositing $SiO_2$ on soda-lime glass by sputtering or the like, or a ceramic such as alumina can be used as the substrate 1.

A general conductive material is used for the opposing device electrodes 4 and 5. For example, a metal such as Ni, Cr, Au, Mo, W, Pt, Ti, Al, Cu, or Pd, or an alloy thereof, a printed conductor formed from glass and a metal such as Pd, Ag, Au, $RuO_2$, or Pd—Ag, or a metal oxide thereof, a transparent conductor such as $In_2O_3$—$SnO_2$, or a semiconductor material such as polysilicon can be appropriately selected.

A spacing L between the device electrodes, a length W of the device electrode, and the shape of the thin conductive film 3 are designed in accordance with the application form.

The spacing L between the device electrodes is preferably several hundreds nm to several hundreds $\mu$m, and more preferably, several $\mu$m to several tens $\mu$m.

The length W of the device electrode is preferably several $\mu$m to several hundreds $\mu$m, considering the resistance value of the electrode and electron emission characteristics. A thickness d of the device electrode is several hundreds Å to several $\mu$m.

The surfaceconduction electron-emitting device shown in FIGS. 1A and 1B has a structure in which the device electrodes 4 and 5 and the thin conductive film 3 are stacked on the substrate 1 in this order. However, the surfaceconduction electron-emitting device may have a structure in which the thin conductive film 3 and the device electrodes 4 and 5 are formed on the substrate 1 in this order.

To obtain satisfactory electron emission characteristics, the thin conductive film 3 is particularly preferably a fine particle film made of fine particles. The thickness of the thin conductive film 3 is appropriately selected depending on the step coverage to the device electrodes 4 and 5, the resistance value between the device electrodes 4 and 5, and the energization forming conditions (to be described later) . The thickness of the thin conductive film 3 is preferably several Å to several thousands Å and particularly preferably, 10 Å to 500 Å. The resistance value indicates a sheet resistance value of $10^3$ to $10^7$ Ω/□.

For the thin conductive film 3, a metal such as Pd, Pt, Ru, Ag, Au, Ti, In, Cu, Cr, Fe, Zn, Sn, Ta, W, or Pb, an oxide such as PdO, $SnO_2$, $In_2O_3$, PbO, or $Sb_2O_3$, a boride such as $HfB_2$, $ZrB_2$, $LaB_6$, $CeB_6$, $YB_4$, or $GdB_4$, a carbide such as TiC, ZrC, HfC, TaC, SiC, or WC, a nitride such as TiN, ZrN, or HfN, a semiconductor such as Si or Ge, or carbon can be used.

The term "a fine particle film" refers to a thin film constituted of the aggregate of a plurality of fine particles that may be dispersed, or arranged to be adjacent to each other or overlap each other (including an island structure). In the fine particle film, the particle diameter of a fine particle is preferably several Å to several thousands Å, and particularly preferably, 10 Å to 200 Å.

The electron emission portion 2 includes fissures, and electron emission is performed near the fissures. The electron emission portion 2 including the fissures and the fissures themselves are formed depending on the thickness, shape, quality, and material of the thin conductive film 3, and the manufacturing method such as energization forming conditions (to be described later). Therefore, the position and shape of the electron emission portion 2 are not specified as those shown in FIGS. 1A and 1B.

The fissures may have fine conductive particles each having a particle diameter of several Å to several hundreds Å. These fine conductive particles are the same as those of part or all of the elements of the material constituting the thin conductive film 3. The electron emission portion 2 including the fissures and the thin conductive film 3 near the electron emission portion 2 may contain carbon or a carbon compound.

The basic structure of a step type surfaceconduction electron-emitting device will be described next.

Figure 2:
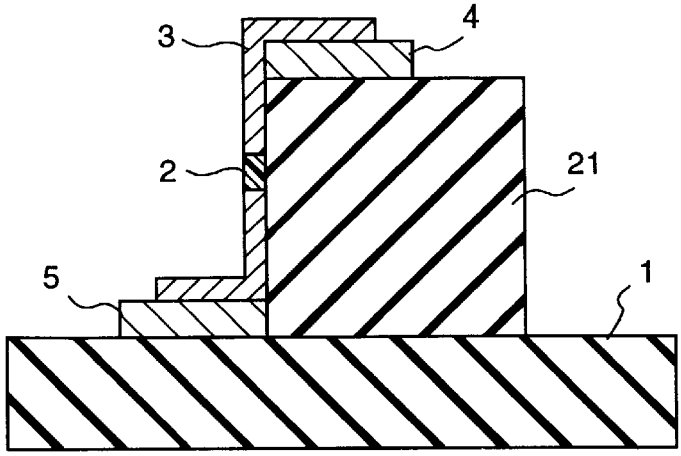
FIG. 2 is a cross-cross-sectional view schematically showing the structure of a step type surfaceconduction electron-emitting device used in the present invention.

FIG. 2 is a cross-cross-sectional view showing the basic structure of the step type surfaceconduction electron-emitting device. Reference numeral 21 denotes a step forming member, and the same reference numerals as in FIGS. 1A and 1B denote the same members in FIG. 2.

The substrate 1, the electron emission portion 2, the thin conductive film 3, and the device electrodes 4 and 5 consist of the same materials as those of the plane type surfaceconduction electron-emitting device described above.

The step forming member 21 is formed of an insulating material such as $SiO_2$ which is formed by vacuum deposition, printing, sputtering, or the like. The thickness of this step forming member 21 corresponds to the spacing L (FIG. 1A) between the device electrodes of the above-described plane type surfaceconduction electron-emitting device and is set depending on the forming method of the step forming member 21, a voltage applied between the device electrodes 4 and 5. Preferably, the thickness of the step forming member 21 is several hundreds Å to several tens $\mu$m, and particularly preferably, several hundreds Å to several $\mu$m.

The thin conductive film 3 is normally formed after formation of the device electrodes 4 and 5, so that the thin conductive film 3 is stacked on the device electrodes 4 and 5. However, the device electrodes 4 and 5 may be formed after formation of the thin conductive film 3 such that the device electrodes 4 and 5 are stacked on the thin conductive film 3. In addition, as described for the plane type surfaceconduction electron-emitting device, the electron emission portion 2 is formed depending on the thickness, shape, quality, and material of the thin conductive film 3, and the manufacturing method such as the energization forming conditions (to be described later). Therefore, the position and shape of the electron emission portion 2 are not specified as those shown in FIG. 2.

Of the above-described plane type surfaceconduction electron-emitting device and vertical type surfaceconduction electron-emitting device, the step type surfaceconduction electron-emitting device will be described below as an example, though the step type surfaceconduction electron-emitting device may replace the plane type surfaceconduction electron-emitting device.

Various methods are available as a method of manufacturing the surfaceconduction electron-emitting device. One example will be described with reference to FIGS. 3A to 3C. The same reference numerals as in FIGS. 1A and 1B denote the same members in FIGS. 3A to 3C.

Figure 3A:
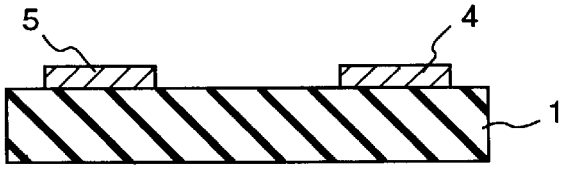
FIGS. 3A to 3C are cross-cross-sectional views showing a method of manufacturing a surfaceconduction electron-emitting device used in the present invention.

1) The substrate 1 is sufficiently cleaned using a detergent, pure water, or an organic solvent. A device electrode material is then deposited by vacuum deposition, sputtering, or the like. Thereafter, the device electrodes 4 and 5 are formed on the surface of the substrate 1 by photolithography (FIG. 3A).

Figure 3B:
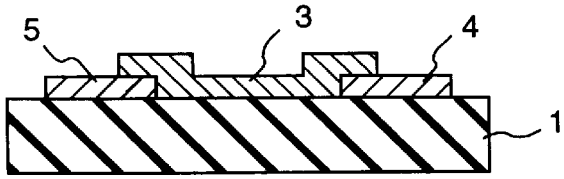

2) The substrate 1 on which the device electrodes 4 and 5 are formed is coated with an organic metal solution and then left standing. With this process, a thin organic metal film is foamed between the device electrodes 4 and 5. The organic metal solution is a solution of an organic compound whose principal ingredient is a metal constituting the thin conductive film 3. Thereafter, the thin organic metal film is subjected to a heating and baking treatment, and patterning is carried out by lift-off or etching to form the thin conductive film 3 (FIG. 3B). An organic metal solution coating process has been described above. However, the present invention is not limited to this technique. The organic metal film can be formed by vacuum deposition, sputtering, chemical vapor deposition, a dispersive coating process, a dipping process, a spinner coating process, or the like.

Figure 3C:
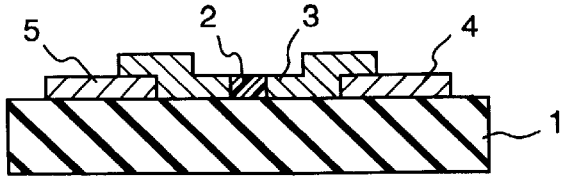

3) Subsequently, an electrification process called "energization forming" is performed. A voltage is applied from a power supply (not shown) across the device electrodes 4 and 5. The electron emission portion 2 having a structure changed from that of the thin conductive film 3 is formed in the thin conductive film 3 (FIG. 3C). With this electrification process, the thin conductive film 3 is locally destroyed, deformed, or changed in properties. The resultant portion of changed structure is referred to as the electron emission portion 2.

Figure 4A:
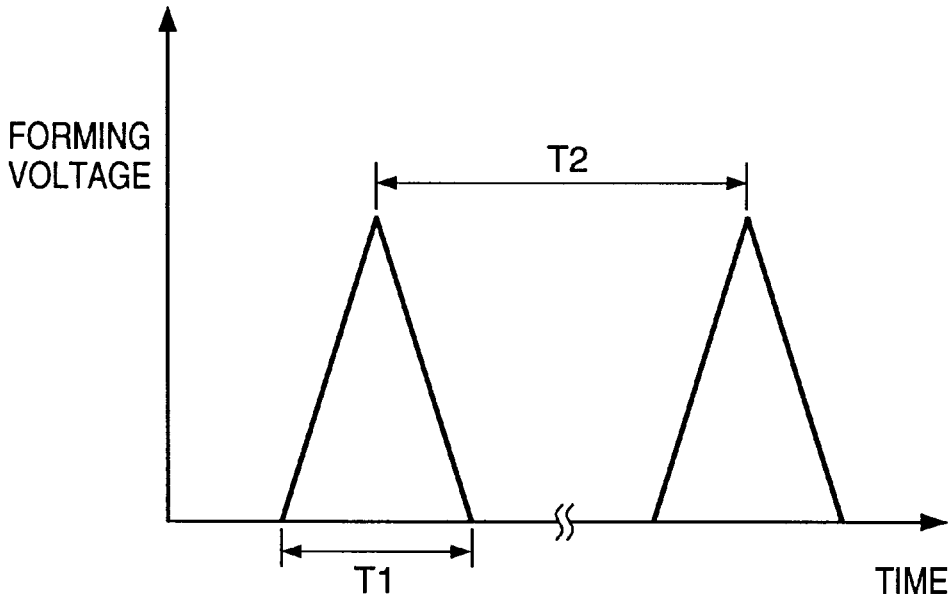
FIGS. 4A and 4B are graphs showing examples of a energization forming waveform.
Figure 4B:
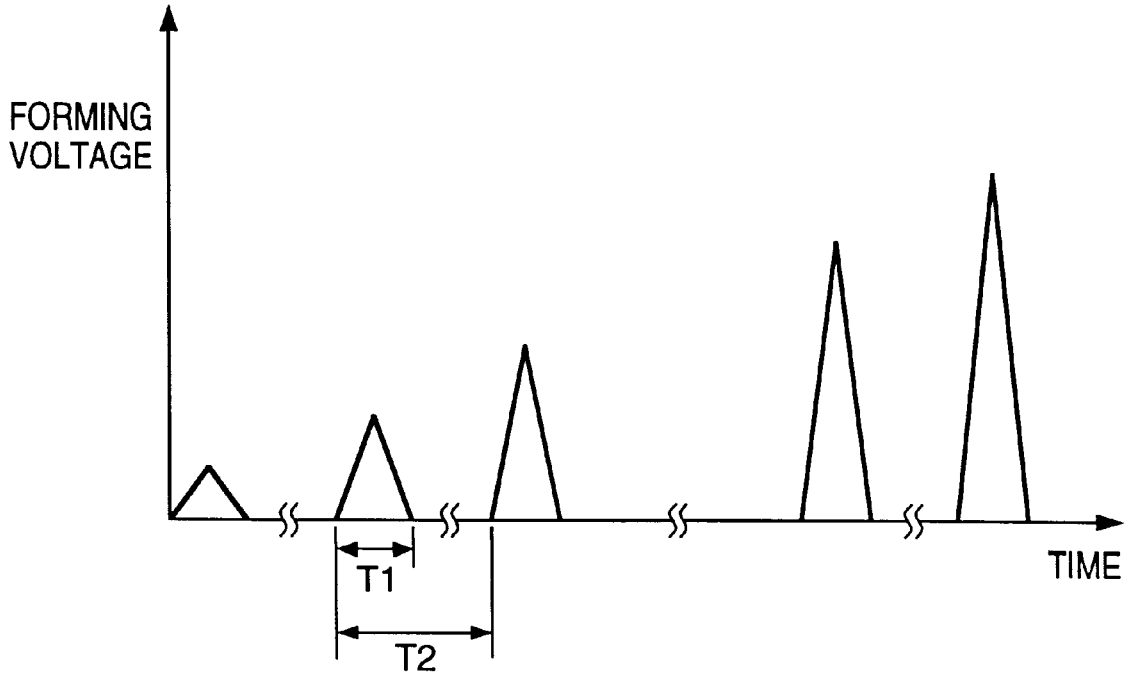

FIGS. 4A and 4B are graphs showing examples of voltage waveforms used in the energization forming process.

The voltage waveform is preferably a pulse waveform. There are two techniques, i.e., a technique of continuously applying a pulse while maintaining a constant peak value (FIG. 4A) and a technique of applying a voltage pulse while increasing the peak value (FIG. 4B).

The technique using a pulse peak value as a constant voltage will be described first with reference to FIG. 4A.

In FIG. 4A, T1 and T2 represent the pulse width and pulse interval of the voltage waveform, respectively. The pulse width T1 is 1 $\mu$sec to 10 msec, and the pulse interval T2 is 10 $\mu$sec to 100 msec. The peak value (the peak voltage at the time of energization forming) is appropriately selected according to the form of the surfaceconduction electron-emitting device. The voltage is applied for several seconds to several tens minutes in a vacuum atmosphere of an appropriate degree of vacuum. The voltage waveform to be applied is not limited to the triangular wave shown in FIG. 4A, and a desired waveform such as a rectangular wave can be used.

The technique of applying a voltage pulse while increasing the peak value will be described next with reference to FIG. 4B.

In FIG. 4B, T1 and T2 are the same as those in FIG. 4A. The voltage is applied while increasing the peak value (the peak voltage at the time of forming) every step of, e.g., 0.1 V in an appropriate vacuum atmosphere as described in FIG. 4A.

During the pulse interval T2, the device current is measured with a voltage of, e.g., 0.1 V, which does not cause local destruction, deformation, or change in properties of the thin conductive film 3 (FIGS. 1A, 1B, and 2), to obtain the resistance value. When a resistance value of 1 MΩ or more is detected, the energization forming process is ended.

4) The device for which the energization forming process is completed is then subjected to a process called an activation process.

The activation process is a process of improving the electron emission characteristics. In the activation process, carbon or a carbon compound is deposited in the periphery of the fissures formed in the energization forming process. With this activation process, the emission current can be made at least ten times larger than before the activation process.

More specifically, the surfaceconduction electron-emitting device is electrified under appropriate conditions in a vacuum atmosphere of $10^{-4}$ to $10^{-5}$ [Torr]. With this process, monocrystalline or polycrystalline graphite, amorphous carbon, or a mixture thereof is generated using, as a raw material, an organic substance present in the vacuum atmosphere, and deposited in the peripheral portion of the fissures. The deposition thickness is preferably smaller than 500 Å.

Electrification to the surfaceconduction electron-emitting device is performed by repeatedly applying a predetermined voltage pulse. When the emission current is simultaneously measured, the progress situation of the activation process can be grasped. When electrification is started, the emission current abruptly increases first. The rate of increase gradually becomes low, and the emission current is saturated finally. When the emission current is saturated, the activation process is ended.

The basic characteristics of the surfaceconduction electron-emitting device obtained in this manner will be described below.

Figure 5:
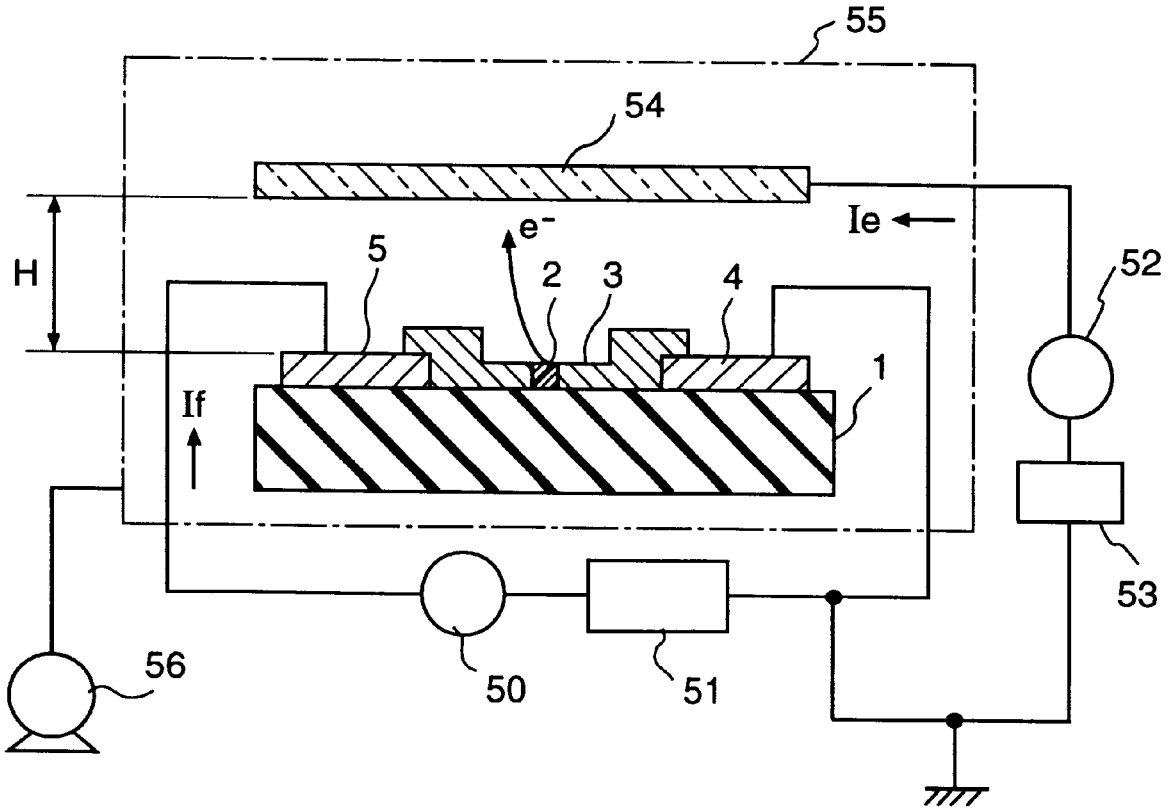
FIG. 5 is a diagram schematically showing the arrangement of a measuring/evaluating apparatus used in the present invention.

FIG. 5 is a diagram schematically showing an example of a measuring/evaluating system for measuring the electron emission characteristics of the surfaceconduction electron-emitting device. This measuring/evaluating system will be described first.

The same reference numerals as in FIGS. 1A and 1B denote the same members in FIG. 5. Reference numeral 51 denotes a power supply for applying a device voltage Vf to the device; 50, an ammeter for measuring a device current If flowing through the thin conductive film 3 between the device electrodes 4 and 5; 54, an anode electrode for capturing an emission current Ie emitted from the electron emission portion 2; 53, a high-voltage power supply for applying a voltage to the anode electrode 54; 52, an ammeter for measuring the emission current Ie emitted from the electron emission portion 2; 55, a vacuum apparatus; and 56, an exhaust pump.

The surfaceconduction electron-emitting device, the anode electrode 54, and the like are arranged in the vacuum apparatus 55. The vacuum apparatus 55 has necessary devices such as a vacuum gauge (not shown), so that measurement/evaluation of the surfaceconduction electron-emitting device can be performed in a desired vacuum atmosphere.

The exhaust pump 56 is constituted by a normal high-vacuum apparatus system comprising a turbo pump or a rotary pump, and an ultra high-vacuum apparatus system comprising an ion pump. The entire vacuum apparatus 55 and the substrate 1 of the surfaceconduction electron-emitting device can be heated to about 200° C. by a heater.

The characteristics are normally measured while setting the voltage of the anode electrode 54 of the measuring/evaluating system to 1 to 10 kV and a distance H between the anode electrode 54 and the surfaceconduction electron-emitting device to 2 to 8 mm.

The basic characteristics of the surfaceconduction electron-emitting device will be described below.

Figure 6:
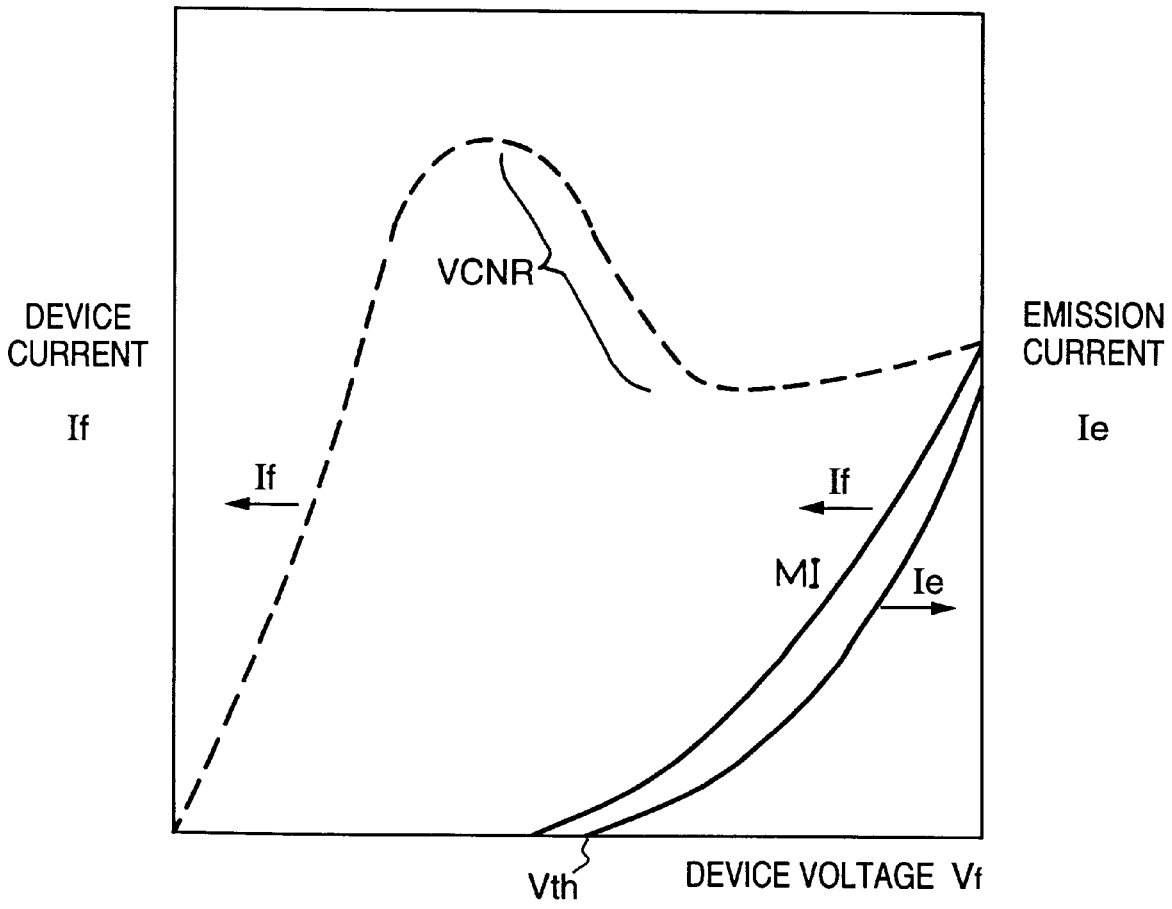
FIG. 6 is a graph showing typical I–V characteristics in a vacuum of about $1\times10^{-6}$ Torr.

FIG. 6 is a graph showing the typical relationship among the emission current Ie, the device current If, and the device voltage Vf. FIG. 6 is illustrated using arbitrary units because the emission current Ie is much smaller than the device current If.

As is apparent from FIG. 6, the surfaceconduction electron-emitting device has three features with respect to the emission current Ie.

First, when the device voltage Vf higher than a certain voltage (to be referred to as a threshold voltage hereinafter: Vth in FIG. 6) is applied to the surfaceconduction electron-emitting device, the emission current Ie abruptly increases. When the applied voltage is lower than the threshold voltage Vth, almost no emission current Ie is detected. That is, the surfaceconduction electron-emitting device is a non-linear device having the clearly defined threshold voltage Vth with respect to the emission current Ie.

Second, since the emission current Ie has a characteristic (to be referred to an MI characteristic hereinafter) representing a monotonous increase with respect to the device voltage Vf, the emission current Ie can be controlled by the device voltage Vf.

Third, the emission charges captured by the anode electrode 54 (FIG. 5) are dependent upon the time over which the device voltage Vf is applied. That is, the amount of charges captured by the anode electrode 54 can be controlled by the time over which the device voltage Vf is applied.

The above-described three features of the surfaceconduction electron-emitting device are basic characteristics which generally appear in a vacuum atmosphere achieved by a conventional exhaust method in the field of vacuum apparatuses, i.e., in an atmosphere at a pressure lower than $10^{-5}$ Torr.

Some electrical characteristics of the surfaceconduction electron-emitting device change depending on the quality of the vacuum atmosphere. For example, the relationship between the device current If flowing between the device electrodes and the applied voltage Vf changes depending on the amount of decrease in partial pressure of an organic gas remaining in the vacuum atmosphere.

When the partial pressure of the organic gas contained in the vacuum atmosphere is relatively high, and the applied voltage Vf is gradually increased, the device current If exhibits a characteristic indicated by a broken line in FIG. 6. That is, when a ramp voltage waveform with a small rising rate is applied, the device current If abruptly increases first. Thereafter, the device current If temporarily decreases and then slightly increases. The characteristic representing that the device current If decreases even when the voltage Vf is increased, which appears midway, is called a voltage controlled negative resistance (to be abbreviated as a VCNR hereinafter).

When the partial pressure of the organic gas remaining in the vacuum atmosphere is sufficiently lowered, i.e., when the partial pressure is lowered to $1\times10^{-7}$ Torr or less, the voltage controlled negative resistance as described above does not appear. That is, as the voltage Vf is increased, the device current If always increases accordingly, as indicated by a solid line in FIG. 6. The ratio of the increase amount of the device current If to that of the voltage Vf is not always constant (i.e., not always linear). However, since a tendency of an increase is always exhibited, this characteristic is called a monotonous increase (to be abbreviated to an MI hereinafter).

In many cases, the origin of the organic gas remaining in the vacuum atmosphere is the vapor of an oil used in the vacuum exhaust unit such as a rotary pump or an oil diffusion pump, or the residue of an organic solvent used in the manufacturing processes of the surfaceconduction electron-emitting device. Examples of the organic gas are aliphatic hydrocarbons such as alkane, alkene, and alkyne, aromatic hydrocarbons, alcohols, aldehydes, ketones, amines, phenols, organic acids such as carboxylic acid and sulfonic acid, or derivatives of the above-described organic substances: more specifically, butadiene, n-hexane, l-hexene, benzene, toluene, O-xylene, benzonitrile, chloroethylene, trichloroethylene, methanol, ethanol, isopropanol, formaldehyde, acetaldehyde, acetone, methyl ethyl ketone, diethyl ketone, methylamine, ethylamine, acetic acid, and propionic acid.

In an environment in which the partial pressure of the organic gas is lowered to a level at which no VCNR appears in the device current If, i.e., in an environment in which the partial pressure of the organic gas is lowered to $1\times10^{-7}$ Torr or less, two interesting features appear in the emission current Ie of the surfaceconduction electron-emitting device, in addition to the above-described three basic characteristics, i.e., a Vmax dependency and a PWmax dependency.

The Vmax dependency and the PWmax dependency will be described below in this order.

Figure 7A:
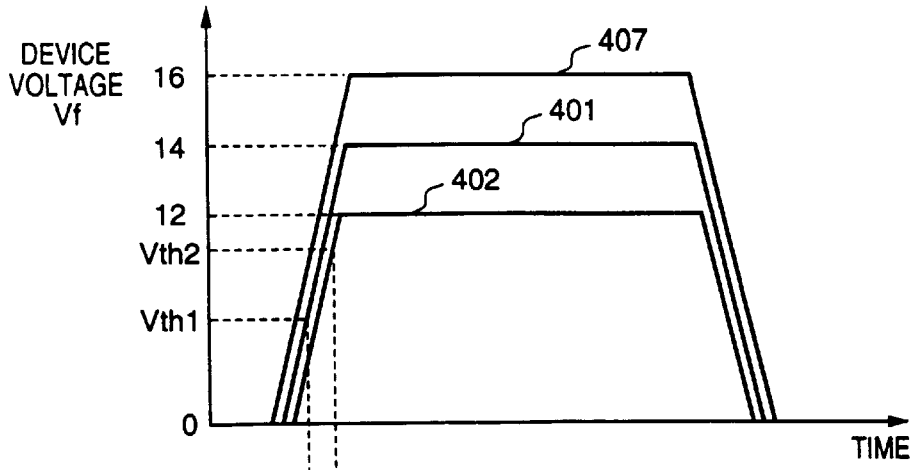
FIGS. 7A to 7F are graphs showing the emission current vs. device voltage characteristics (I–V characteristics) of the surfaceconduction electron-emitting device used in the present invention.
Figure 7B:
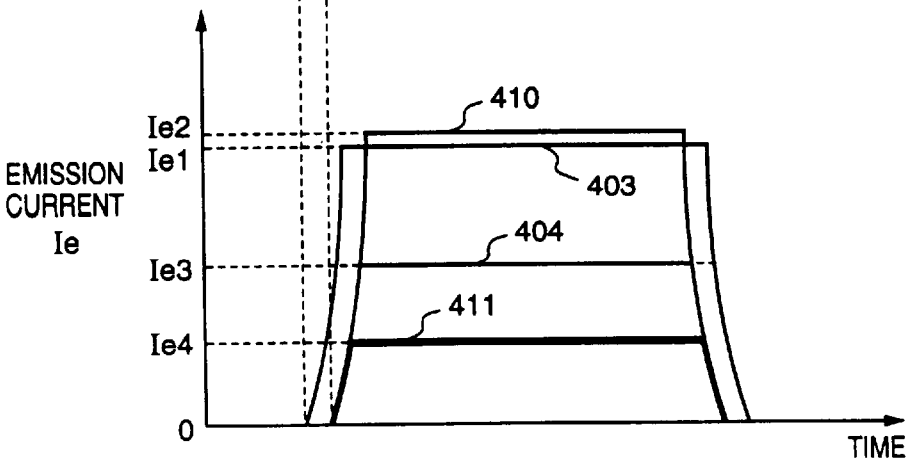
Figure 7C:
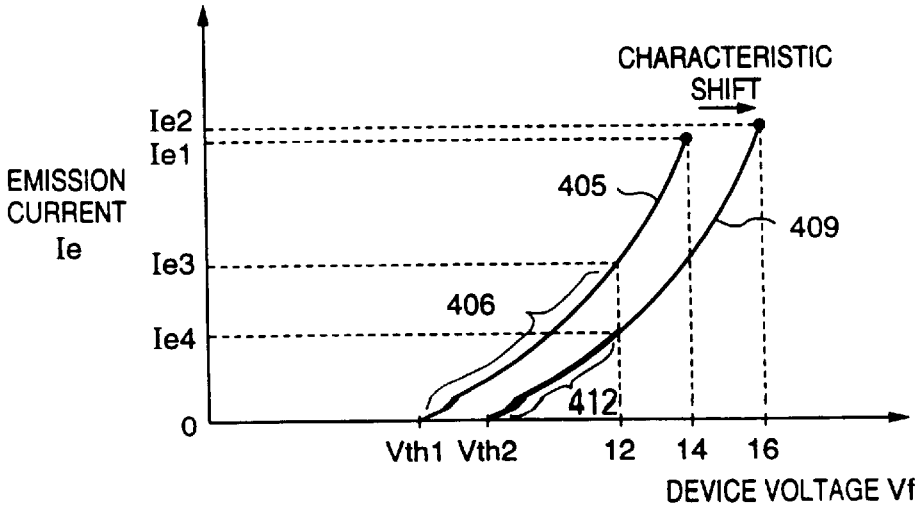

The Vmax dependency is a characteristic representing that the (emission current Ie vs. device voltage Vf) characteristic is defined depending on the maximum value (to be referred to as a value Vmax hereinafter) of the device voltage applied to the surfaceconduction electron-emitting device. In this case, the value Vmax means the maximum value of the voltage applied to the device after the partial pressure of the organic gas is lowered. Assume that the surfaceconduction electron-emitting device for which the energization forming process and the activation process are completed is set in a vacuum atmosphere in which the partial pressure of an organic gas is sufficiently lowered, and a voltage pulse having a peak value of 14 V and a width of about 16 msec, as indicated by a solid line 401 in FIG. 7A, is applied to the device at a frequency of 60 Hz first. The value Vmax at this time is 14 V, as a matter of course. The waveform of the emission current Ie at this time is indicated by a solid line 403 in FIG. 7B. In addition, the (emission current Ie vs. device voltage Vf) characteristic is indicated by a solid curve 405 in FIG. 7C. Vth1 in FIG. 7A represents an electron emission threshold voltage. As long as the pulse having a peak value of 14 V or less is applied, the profile of the characteristic curve 405 in FIG. 7C does not change (the pulse width and the frequency are assumed to be constant). Therefore, when a pulse having a peak value of 12 V, as indicated by a solid line 402 in FIG. 7A, is applied, the emission current Ie indicated by a solid line 404 in FIG. 7B and a solid curve 406 in FIG. 7C is output.

Assume that a voltage pulse having a peak value of 16 V, as indicated by a solid line 407 in FIG. 7A, is applied. At this point of time, the value Vmax changes from 14 V to 16 V, and the (emission current Ie vs. device voltage Vf) characteristic changes accordingly. As indicated by a solid curve 409 in FIG. 7C, the characteristic curve has an almost similar profile, though the electron emission threshold voltage shifts from Vth1 to Vth2. Consequently, the emission current Ie changes as indicated by a solid line 410 in FIG. 7B. While a voltage higher than 16 V is not applied and if the value Vmax is not updated, the emission current Ie exhibits the characteristic indicated by the solid curve 409 in FIG. 7C. In other words, when the value Vmax is updated, the characteristic curve shifts to the right side, and this characteristic is stored until the value Vmax is further updated. Therefore, when the voltage pulse having the peak value of 12 V, as indicated by the solid line 402 in FIG. 7A, is applied again, the emission current Ie as indicated by a solid line 411 in FIG. 7B and a solid curve 412 in FIG. 7C is output, unlike the case wherein the pulse having the peak value of 12 V is applied before the value Vmax is updated.

When the partial pressure of the organic gas is temporarily lowered and then raised again, the electron emission characteristic stored in lowering the partial pressure is reset upon application of the device voltage in an environment at an increased partial pressure.

The PWmax dependency will be described next.

Figure 7D:
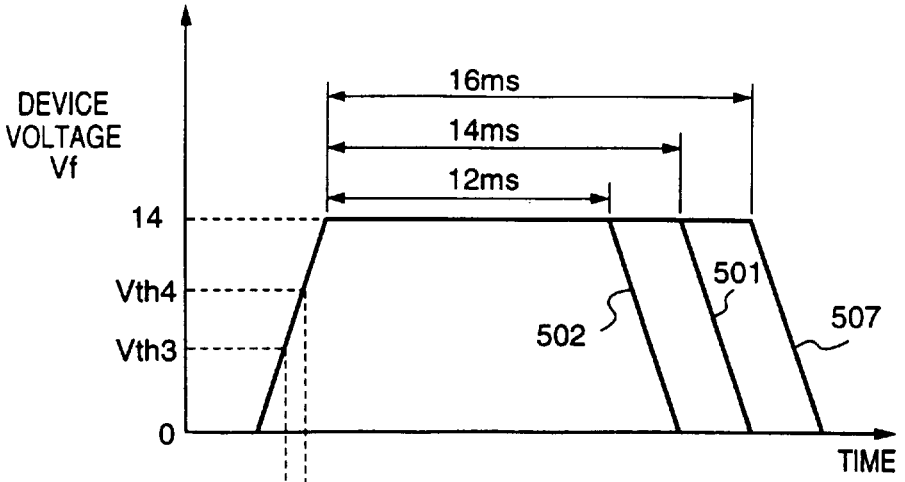
Figure 7E:
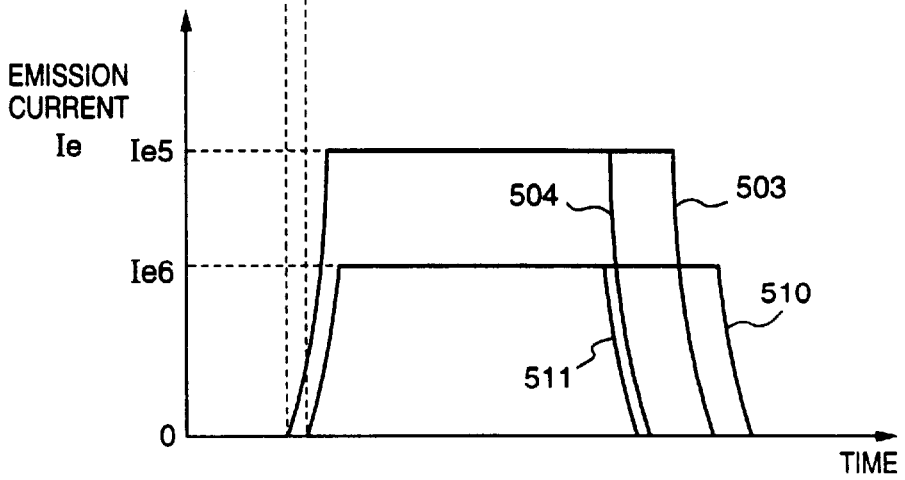
Figure 7F:
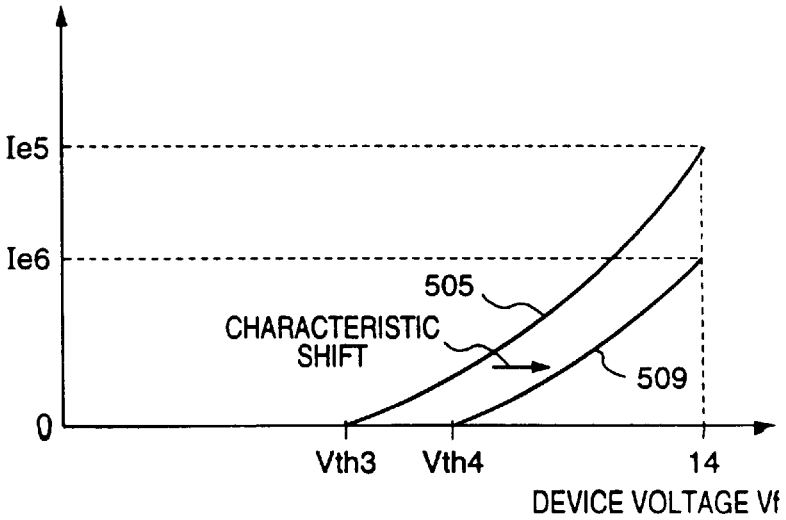

The PWmax dependency is a characteristic representing that the (emission current Ie vs. device voltage Vf) characteristic is defined depending on the maximum value (to be referred to as a value PWmax hereinafter) of the pulse width of the voltage pulse applied to the surfaceconduction electron-emitting device. In this case, the value PWmax means the maximum value of the width of the voltage pulse applied to the device after the partial pressure of the organic gas is lowered. Assume that the surfaceconduction electron-emitting device for which the energization forming process and the activation process are completed is set in a vacuum atmosphere in which the partial pressure of an organic gas is sufficiently lowered, and that a voltage pulse having a width of 14 msec and a peak value of 14 V, as indicated by a solid line 501 in FIG. 7D, is applied to the device at a frequency of 60 Hz first. The value PWmax at this time is 14 msec, as a matter of course. The waveform of the emission current Ie at this time is indicated by a solid line 503 in FIG. 7E. In addition, the (emission current Ie vs. device voltage Vf) characteristic is indicated by a solid curve 505 in FIG. 7F. Vth3 in FIG. 7F represents an electron emission threshold voltage. As long as the pulse having a pulse width of 14 msec or less is applied, the profile of the characteristic curve 505 does not change (the peak value and the frequency are assumed to be constant). Therefore, when a pulse having a pulse width of 12 msec, as indicated by a solid line 502 in FIG. 7D, is applied, the emission current Ie as indicated by a solid line 504 in FIG. 7E is output. Assume that a voltage pulse having a pulse width of 16 msec, as indicated by a solid line 507 in FIG. 7D, is applied. At this point of time, the value Pwmax changes from 14 msec to 16 msec, and the (emission current Ie vs. device voltage Vf) characteristic changes accordingly. As indicated by a solid curve 509 in FIG. 7F, the characteristic curve has an almost similar profile, though the electron emission threshold voltage shifts from Vth3 to Vth4. Consequently, the emission current Ie changes as indicated by a solid line 510 in FIG. 7E. While a pulse having a width smaller than 16 msec is applied and if the value PWmax is not updated, the emission current Ie exhibits the characteristic indicated by the solid curve 509 in FIG. 7F. In other words, when the value PWmax is updated, the characteristic curve shifts to the right side, and this characteristic is stored until the value PWmax is further updated. Therefore, when the voltage pulse having the pulse width of 12 msec, as indicated by the solid line 502 in FIG. 7D, is applied again, the emission current Ie as indicated by a solid line 511 in FIG. 7E is output, unlike the case wherein the pulse having the pulse width of 12 msec is applied before the value PWmax is updated.

When the partial pressure of the organic gas is temporarily lowered and then raised again, the electron emission characteristic stored in lowering the partial pressure is reset upon application of the device voltage in an environment at an increased partial pressure.

The electron source of the present invention is constituted by arranging a plurality of surfaceconduction electron-emitting devices having the above characteristics in an array on a substrate.

However, the electron emission characteristics of the plurality of surfaceconduction electron-emitting devices arranged on the substrate vary due to various factors generated in the above-described manufacturing processes. Therefore, the surfaceconduction electron-emitting devices of the electron source of the present invention are subjected to a process of uniforming the characteristics of the surfaceconduction electron-emitting devices. This process is performed as a correction process.

The correction process as the gist of the present invention will be described below.

The correction process is performed to uniform the characteristics of the surfaceconduction electron-emitting devices. The electron emission characteristics of the plurality of surfaceconduction electron-emitting devices formed for an electron source or an image forming apparatus are examined, and a correction voltage (to be described later) is applied to a selected surfaceconduction electron-emitting device, thereby minimizing the variations in characteristics of the surfaceconduction electron-emitting devices.

More specifically, the above-described Vmax dependency or PWmax dependency is used to correct the electron emission characteristics of the selected surfaceconduction electron-emitting device.

First, each surfaceconduction electron-emitting device is operated with a voltage having the maximum peak value Vmax and maximum pulse width PWmax of the driving voltage pulse which is practically used to drive the surfaceconduction electron-emitting device, thereby measuring the electron emission characteristics of the surfaceconduction electron-emitting devices.

Referring to the measurement result, the electron emission characteristic as a reference is determined. More specifically, the characteristic of the one of all the surfaceconduction electron-emitting devices that has exhibited the minimum emission current Ie is defined as a reference characteristic. In other words, the characteristic of the one of all the surfaceconduction electron-emitting devices that has exhibited the maximum electron emission threshold voltage Vth is defined as a reference characteristic.

A characteristic correction voltage pulse is applied to a surfaceconduction electron-emitting device having a characteristic different from the reference characteristic, thereby matching the characteristic of the device with the reference characteristic. To correct the electron emission characteristic, one or both of the Vmax dependency and the PWmax dependency may be used. With this process, the electron emission characteristic (Vf-Ie characteristic) of each surfaceconduction electron-emitting device is changed such that electron emission is equally performed in all the surfaceconduction electron-emitting devices when the devices are driven with an practical driving waveform. As described above, the characteristics of each surfaceconduction electron-emitting device include memory properties. For this reason, unless a new value Vmax or PWmax is applied, the electron emission characteristics of the plurality of surfaceconduction electron-emitting devices subjected to the correction process once are kept almost uniform.

Since the surfaceconduction electron-emitting device constituting the electron source of the present invention has the Vmax dependency and the PWmax dependency, the values Vmax and PWmax may be updated by electrical noise from the inside or outside of the apparatus using the surfaceconduction electron-emitting devices. To improve the resistance against electrical noise, the peak value and pulse width of the correction waveform are preferably large. However, considering the electron emission characteristics desired for the apparatus using the electron source of the present invention, the peak value and pulse width of the correction waveform are set to be desired values.

As described above, in the electron source of the present invention, since the electron emission characteristics of the surfaceconduction electron-emitting devices are uniform, correction in driving the devices, which was conventionally necessary, becomes unnecessary.

The arrangement of the surfaceconduction electron-emitting devices in the electron source of the present invention will be described below.

As an arrangement scheme of surfaceconduction electron-emitting devices in the electron source of the present invention, there are a ladder-shaped array as described in the prior art, and an arrangement scheme in which n Y-direction wiring layers are arranged on m X-direction wiring layers through an insulating interlayer, and the X-direction wiring layers and the Y-direction wiring layers are connected to the pairs of device electrodes of the surfaceconduction electron-emitting devices. This arrangement will be referred to as a simple matrix arrangement hereinafter. This simple matrix arrangement will be described first in detail.

According to the above-described basic characteristics of the surfaceconduction electron-emitting device, electrons emitted from the surfaceconduction electron-emitting devices arranged in the simple matrix arrangement can be controlled by the peak value and pulse width of the pulse voltage applied across the opposing device electrodes as long as the voltage is higher than the threshold voltage. On the other hand, when the voltage is lower than the threshold voltage, almost no electrons are emitted. Even in an arrangement of a large number of surfaceconduction electron-emitting devices, surfaceconduction electron-emitting devices can be selected in accordance with an input signal by appropriately applying the pulse voltage to each device, and the electron emission amount can be controlled. Therefore, the individual surfaceconduction electron-emitting devices can be selected and independently driven by simple matrix wiring.

The simple matrix arrangement is based on this principle and an example of the electron source of the present invention. The arrangement of the electron source having the simple matrix arrangement will be further described with reference to FIG. 8.

Figure 8:
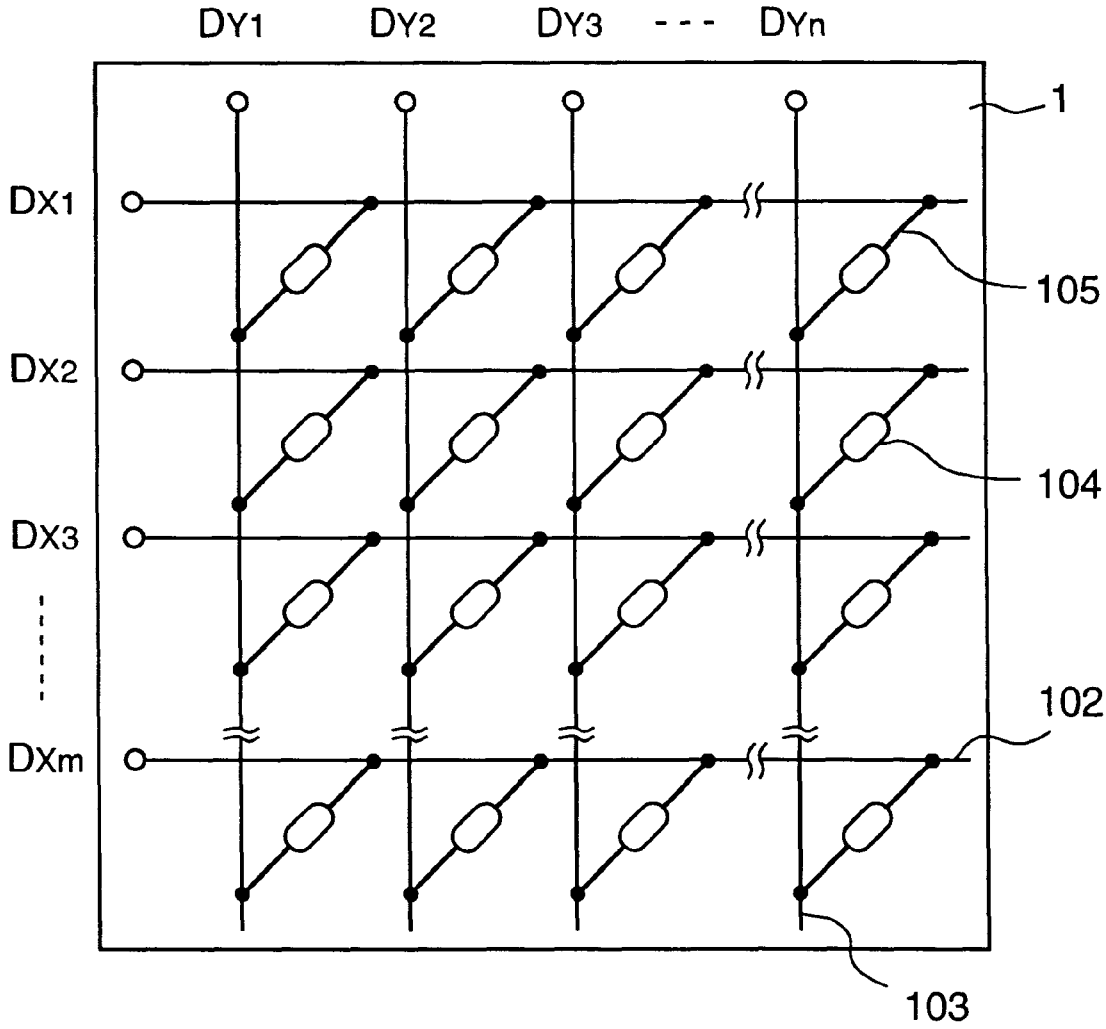
FIG. 8 is a view schematically showing the structure of an electron source of the present invention, which has a simple matrix arrangement.

Referring to FIG. 8, the substrate 1 is formed of a glass plate or the like, as described above. The number and shape of surfaceconduction electron-emitting devices 104 arranged on the substrate 1 are appropriately set in accordance with the application purpose.

M X-direction wiring layers 102 have external terminals Dx1, Dx2, . . . , Dxm, respectively, and consist of a conductive metal or the like formed on the substrate 1 by vacuum deposition, printing, or sputtering. The material, thickness, and width of each wiring layer are set such that a voltage is almost uniformly applied to the large number of surfaceconduction electron-emitting devices 104.

N Y-direction wiring layers 103 have external terminals Dy1, Dy2, . . . , Dyn, respectively, and are formed in a similar manner to that for the X-direction wiring layers 102.

An insulating interlayer (not shown) is formed between the m X-direction wiring layers 102 and the n Y-direction wiring layers 103 to electrically separate the X-direction wiring layers 102 from the Y-direction wiring layers 103, thereby forming matrix wiring. Note that both m and n are positive integers.

The insulating interlayer (not shown) is an $SiO_2$ layer or the like formed by vacuum deposition, printing, or sputtering, which is formed into a desired shape on the entire surface or part of the surface of the substrate 1 on which the X-direction wiring layers 102 are formed. Particularly, the thickness, material, and manufacturing method of the insulating interlayer are appropriately set such that the insulating interlayer can stand the potential difference between the X-direction wiring layers 102 and the Y-direction wiring layers 103.

The opposing device electrodes (not shown) of the surfaceconduction electron-emitting devices 104 are electrically connected to the m X-direction wiring layers 102 and the n Y-direction wiring layers 103 through connection lines 105 consisting of a conductive metal or the like formed by vacuum deposition, printing, or sputtering.

When the wiring layers to the device electrodes consist of the same material as that of the device electrodes, the wiring layers and the device electrodes may be called device electrodes as a whole. The surfaceconduction electron-emitting devices 104 may be formed either on the substrate 1 or on the insulating interlayer (not shown).

A scanning signal application means (not shown) for applying a scanning signal is electrically connected to the X-direction wiring layers 102 to scan the rows of the surfaceconduction electron-emitting devices 104 arranged in the X direction in accordance with an input signal, though this will be described later in detail.

On the other hand, a modulating signal generation means (not shown) for supplying a modulating signal is electrically connected to the Y-direction wiring layers 103 to modulate each column of the surfaceconduction electron-emitting devices 104 arranged in the Y direction in accordance with an input signal. The driving voltage applied to each of the surfaceconduction electron-emitting devices 104 is supplied as a difference voltage between the scanning signal (row) and the modulating signal (column), which are supplied to the surfaceconduction electron-emitting device 104.

Figure 9:
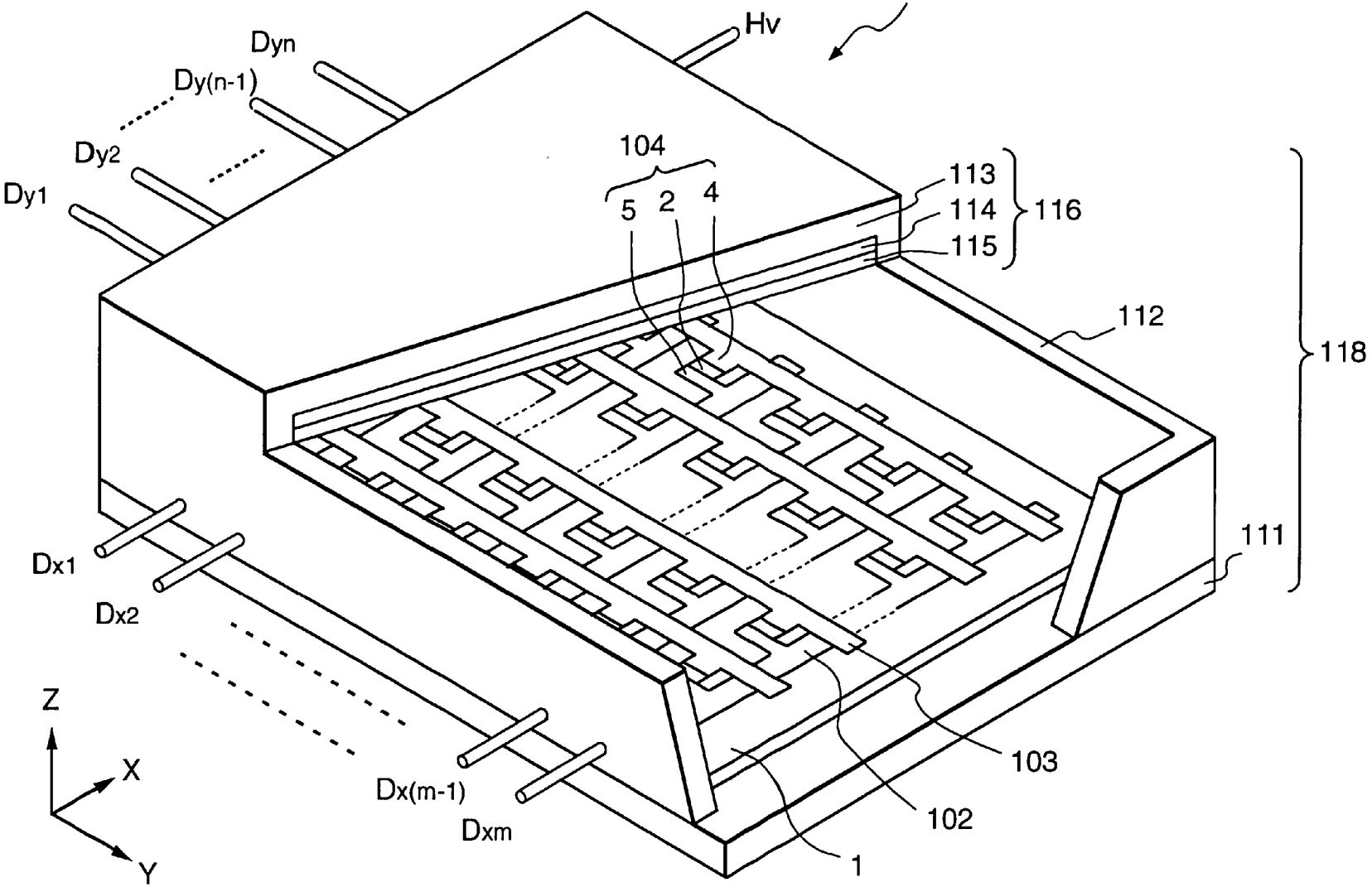
FIG. 9 is a perspective view schematically showing the arrangement of a display panel used in an image forming apparatus of the present invention using the electron source with the simple matrix arrangement.
Figure 10A:
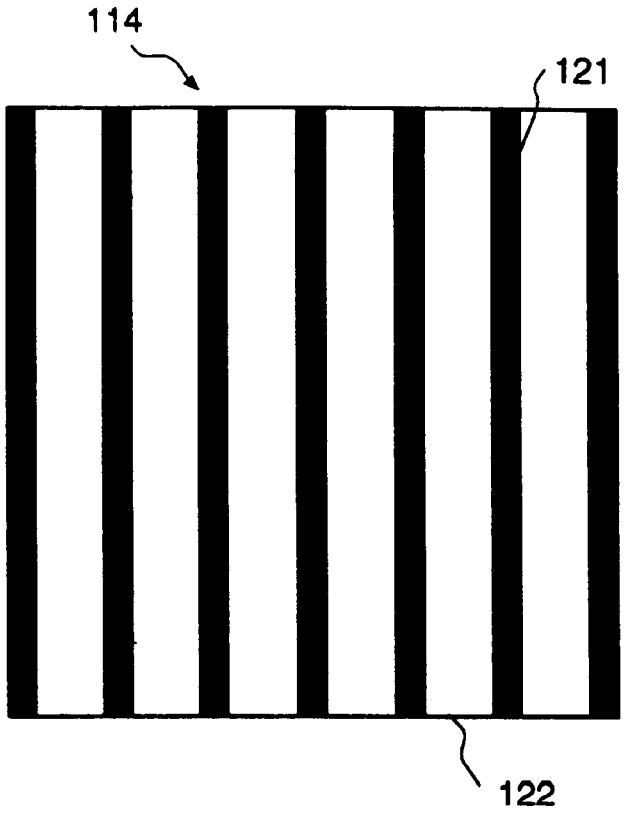
FIGS. 10A and 10B are views showing phosphor films of the display panel shown in FIG. 9.
Figure 10B:
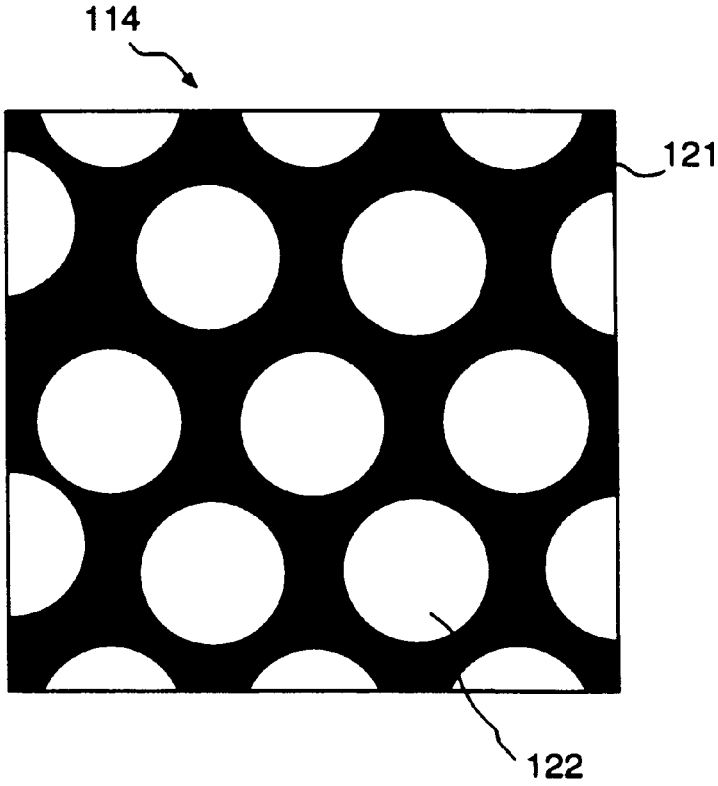
Figure 11:
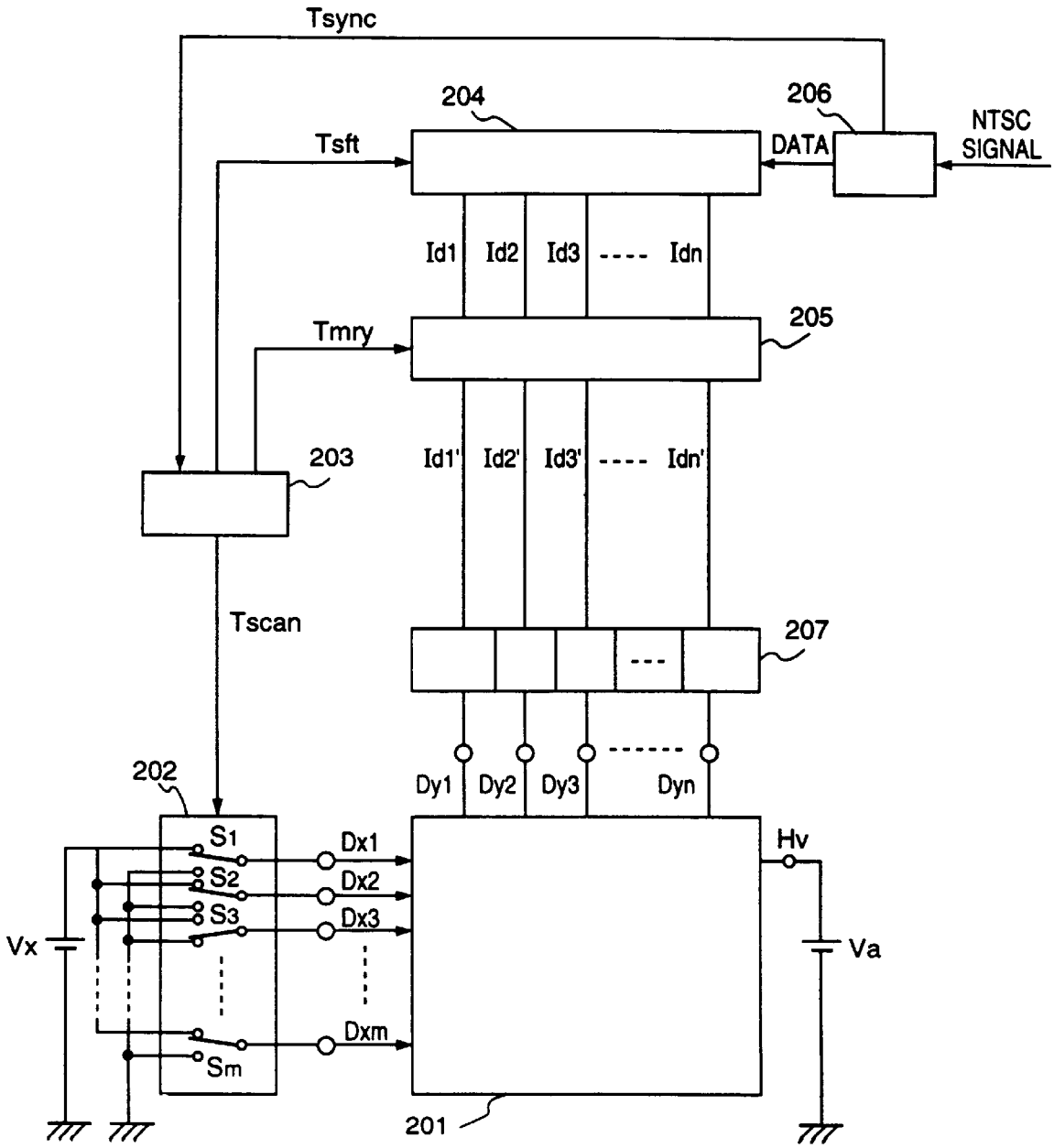
FIG. 11 is a circuit diagram showing an example of a driving circuit for driving the display panel shown in FIG. 9.

An example of the image forming apparatus of the present invention using the electron source of the present invention with the simple matrix arrangement above will be described below with reference to FIGS. 9 to 11. FIG. 9 is a perspective view showing the basic arrangement of a display panel 201. FIGS. 10A and 10B are views showing examples of a phosphor film 114. FIG. 11 is a block diagram showing an example of a driving circuit for performing TV display in accordance with an NTSC television signal on the display panel 201 shown in FIG. 9.

Referring to FIG. 9, the surfaceconduction electron-emitting devices are arranged on the substrate 1 of the electron source as in the above-described manner. Reference numeral 111 denotes a rear plate on which the substrate 1 is fixed; 116, a face plate having a glass substrate 113 with the phosphor film 114 and a metal back 115, which are formed on the inner surface of the glass substrate 113; and 112, a supporting frame. The rear plate 111, the supporting frame 112, and the face plate 116 are bonded with frit glass and construct an envelope 118.

In FIG. 9, reference numeral 2 corresponds to the electron emission portion shown in FIG. 1. The X-direction wiring layers 102 and Y-direction wiring layers 103 are connected to the pairs of device electrodes 4 and 5 of the surfaceconduction electron-emitting devices 104 and have the external terminals Dx1 to Dxm or Dy1 to Dyn, respectively.

As described above, the envelope 118 is constituted by the face plate 116, the supporting frame 112, and the rear plate 111. However, since the rear plate 111 is provided mainly for the purpose of reinforcing the substrate 1, it may be omitted with if the substrate 1 itself has a sufficient strength. The supporting frame 112 may be sealed directly on the substrate 1 so that the envelope 118 may be constituted by the face plate 116, the supporting frame 112, and the substrate 1.

The phosphor film 114 comprises only a phosphor 122 if the apparatus is for monochromatic use. In the case of the phosphor film 114 for color, however, the phosphor film 114 comprises a black conductive material 121 called black stripes (FIG. 10A) or a black matrix (FIG. 10B), and the phosphor 122. The purpose of providing the black stripes or black matrix is to make color mixing and the like less conspicuous by blacking the coated portions between the phosphors 122, which are phosphors of the three primary colors necessary to present a color display, and to suppress a decline in contrast caused by reflection of external light at the phosphor film 114. As for the material constituting the black conductive material 121, use can be made of a substance whose principal ingredient is graphite, and any material may be used so long as it is electrically conductive and allows but little light to pass through and to be reflected.

As for the methods of coating the glass substrate 113 with the phosphor 122, a precipitation method or printing method is used independently of whether the display is monochromatic or color.

As shown in FIG. 9, the metal back 115 is normally formed on the inner surface of the phosphor film 114. The purpose of the metal back 115 is to raise luminance by reflecting the part of the light emitted from the phosphor 122 (FIGS. 10A and 10B), which is directed toward the inner surface, to the face plate 116 side, to act as an electrode for applying an accelerating voltage to the electron beam, and to protect the phosphor 122 against damage due to bombardment of negative ions generated within the envelope 118. The metal back 115 can be fabricated by applying a smoothing treatment (usually referred to as "filming") to the inner surface of the phosphor film 114 after the phosphor film 114 is formed, and then depositing aluminum (Al) by vacuum deposition or the like.

In order to improve the conductivity of the phosphor film 114, a transparent electrode (not shown) may be formed on the outer surface side of the phosphor film 114 of the face plate 116.

When the above-described sealing operation is to be performed, it is required that sufficient positioning is carried out because the phosphors 122 of various colors and the surfaceconduction electron-emitting devices must be made correspond in the case of a color display.

The envelope 118 is evacuated to about $10^{-7}$ Torr through an exhaust pipe (not shown) and sealed. Immediately before or after sealing the envelope 118, a getter treatment may be applied, in which a getter (not shown) arranged at a predetermined position in the envelope 118 is heated to form a deposited film. Usually, the principal ingredient of the getter is Ba or the like. A vacuum of, e.g., $1\times10^{-5}$ to $1\times10^{-7}$ Torr is maintained by the adsorbing action of the deposited film.

The above-described forming process and subsequent manufacturing steps of the surfaceconduction electron-emitting device are normally performed immediately before or after sealing the envelope 118, and their contents are the same as those described above.

The display panel 201 can be driven by a driving circuit as shown in FIG. 11. In FIG. 11, reference numeral 201 denotes the display panel; 202, a scanning circuit; 203, a control circuit; 204, a shift register; 205, a line memory; 206, a synchronizing-signal separating circuit; 207, and a modulating signal generator. Reference symbols Vx and Va denote DC voltage sources.

As shown in FIG. 11, the display panel 201 is connected to an external electronic circuit through the external terminals Dx1 to Dxm, the external terminals Dy1 to Dyn, and a high-voltage terminal Hv. Scanning signals for sequentially driving the surfaceconduction electron-emitting devices arranged in the display panel 201, i.e., the surfaceconduction electron-emitting device group arranged in an m×n matrix, one row (n devices) at a time, are supplied to the external terminals Dx1 to Dxm.

Modulating signals for controlling output electron beams from the respective surfaceconduction electron-emitting devices of one row which is selected by the scanning signal are supplied to the external terminals Dy1 to Dyn. A DC voltage of, e.g., 10 kV is applied from the DC voltage source Va to the high-voltage terminal Hv. This DC voltage is an accelerating voltage for imparting the electron beams output from the surfaceconduction electron-emitting devices with sufficient energy to excite the phosphors 122.

The scanning circuit 202 incorporates m switching devices (schematically illustrated by S1 to Sm in FIG. 11). Each of the switching devices S1 to Sm selects the output voltage of the DC power supply Vx or 0 V (ground level) and electrically connects the selected voltage to a corresponding one of the external terminals Dx1 to Dxm of the display panel 201. The switching devices S1 to Sm operate on the basis of a control signal Tscan output from the control circuit 203. The switching devices S1 to Sm can be easily constituted by combining devices such as FETs having a switching function.

The DC voltage source Vx of this embodiment is set, based on the characteristic (threshold voltage Vth) of the surfaceconduction electron-emitting devices, so as to output such a constant voltage that the driving voltage applied to a device not being scanned will fall below the threshold voltage Vth.

The control circuit 203 acts to coordinate the operation of each component so as to present an appropriate display on the basis of an externally input image signal. On the basis of a synchronizing signal Tsync sent from the synchronizing-signal separating circuit 206 (to be described below), the control circuit 203 generates control signals Tscan, Tsft, and Tmry to each of the components.

The synchronizing-signal separating circuit 206 is a circuit for separating a synchronizing signal component and a luminance signal component from an externally input NTSC television signal. As is well known, the synchronizing-signal separating circuit 206 can be easily constituted using a frequency separating circuit (filter). The synchronizing signal separated by the synchronizing-signal separating circuit 206 comprises a vertical synchronizing signal and a horizontal synchronizing signal, as is well known. For the descriptive convenience, these signals are represented by the signal Tsync. The luminance signal component of the image, which is separated from the television signal, is represented by a DATA signal, for the descriptive convenience. This DATA signal is input to the shift register 204.

The shift register 204 converts the DATA signal which is time-serially input as a serial signal into a parallel signal in units of lines of the image and operates on the basis of the control signal Tsft sent from the control circuit 203. The control signal Tsft may be referred to as the shift clock of the shift register 204. The serial/parallel-converted data of one line of the image (corresponding to drive data of n surface-conduction electron-emitting devices) is output from the shift register 204 as n parallel signals Id1 to Idn.

The line memory 205 is a memory for storing one line of image data for a requisite period of time. The line memory 205 appropriately stores the contents of Id1 to Idn in accordance with the control signal Tmry sent from the control circuit 203. The stored contents are output as I'd1 to I'dn and input to the modulating signal generator 207.

The modulating signal generator 207 is a signal source for appropriately modulating and driving each of the surface-conduction electron-emitting devices in accordance with the image data I'd1 to I'dn. The output signals from the modulating signal generator 207 are supplied to the surfaceconduction electron-emitting devices in the display panel 201 through terminals Dy1 to Dyn.

As described above, the surfaceconduction electron-emitting device has a clearly defined threshold voltage Vth for electron emission. Only when a voltage higher than the threshold voltage Vth is applied, electron emission is performed. When the applied voltage is higher than the threshold voltage Vth, the emission current also changes according to a change in voltage applied to the surfaceconduction electron-emitting device. By changing the material, structure, and manufacturing method of the surfaceconduction electron-emitting device, the degree of change in emission current with respect to the threshold voltage value or applied voltage may be changed. In any case, the following control operations can be made.

In a case wherein a pulsed voltage is applied to the surfaceconduction electron-emitting device, no electron emission takes place even if a voltage equal to or lower than the threshold voltage Vth is applied. In a case wherein a voltage higher than the threshold voltage Vth is applied, however, electron emission occurs. First, the intensity of the output electron beam can be controlled by changing the peak value of the voltage pulse. Second, the total amount of charges of the output electron beam can be controlled by changing the width of the voltage pulse.

A voltage modulation method and a pulse-width modulation method can be mentioned as methods of modulating the surfaceconduction electron-emitting device in accordance with an input signal. In the voltage modulation method, a circuit used as the modulating signal generator 207 employs a voltage modulation method according to which voltage pulses of a predetermined width are generated but the peak value of the pulses is suitably modulated in conformity with the input data. In the pulse-width modulation method, a circuit used as the modulating signal generator 207 employs a pulse-width modulation method according to which voltage pulses having a predetermined peak value are generated but the width of the voltage pulses is suitably modulated in conformity with the input data.

The shift register 204 and the line memory 205 may be of a digital or analog signal type. What is important is that parallel/serial conversion of the image signal and storage of the converted signal be performed at a predetermined speed.

In the case of a digital signal, it is necessary to convert the output signal DATA from the synchronizing-signal separating circuit 206 into a digital signal. This can be realized by arranging an A/D converter at the output portion of the synchronizing-signal separating circuit 206.

In association with this arrangement, the circuit arranged in the modulating signal generator 207 changes depending on whether the output signal from the line memory 205 is a digital signal or an analog signal.

When a digital signal and the voltage modulation method are used, a well-known D/A converter can be used for the modulating signal generator 207, and an amplification circuit can be added, as needed. When a digital signal and the pulse-width modulation method are used, the modulating signal generator 207 can be easily constituted by a circuit formed by combining a high-speed oscillator, a counter for counting the number of waves output from the oscillator, and a comparator for comparing the output value of the counter with the output value of the memory. An amplifier may be added as needed to voltage-amplify the pulse-width modulated signal output from the comparator to the driving voltage of the surfaceconduction electron-emitting device.

When an analog signal and the voltage modulation method are used, an amplification circuit using a well-known operational amplifier can be used for the modulating signal generator 207, and a level shift circuit may be added, as needed. When an analog signal and the pulse-width modulation method are used, a well-known voltage-controlled oscillator (VCO) can be used. An amplifier may be added as needed to voltage-amplify the signal to the driving voltage of the surfaceconduction electron-emitting device.

In the image forming apparatus of the present invention, which has the display panel 201 and the driving circuit, when a voltage is applied through the terminals Dx1 to Dxm and Dy1 to Dyn, electrons can be emitted from the desired surfaceconduction electron-emitting devices. A high voltage is applied to the metal back 115 or a transparent electrode (not shown) through the high-voltage terminal Hv to accelerate the electron beams. In accordance with excitation and light emission which are caused by bombardment of the accelerated electron beams against the phosphor film 114, television display can be performed on the basis of an NTSC television signal.

The above-described arrangement is necessary to obtain the image forming apparatus of the present invention used for a display operation. The details including the materials of the respective members are not limited to those described above and can be appropriately selected in accordance with the application purpose of the image forming apparatus. In the above description, an NTSC signal is exemplified as an input signal. However, the image forming apparatus of the present invention is not limited to the NTSC system and can also be applied to another system such as a PAL or a SECAM system. The present invention can also be applied to a high-definition TV system represented by the MUSE system using a TV signal comprising a larger number of scanning lines.

Examples of the electron source having a ladder-shaped array and the image forming apparatus of the present invention using the electron source will be described below with reference to FIGS. 12 and 13.

Figure 12:
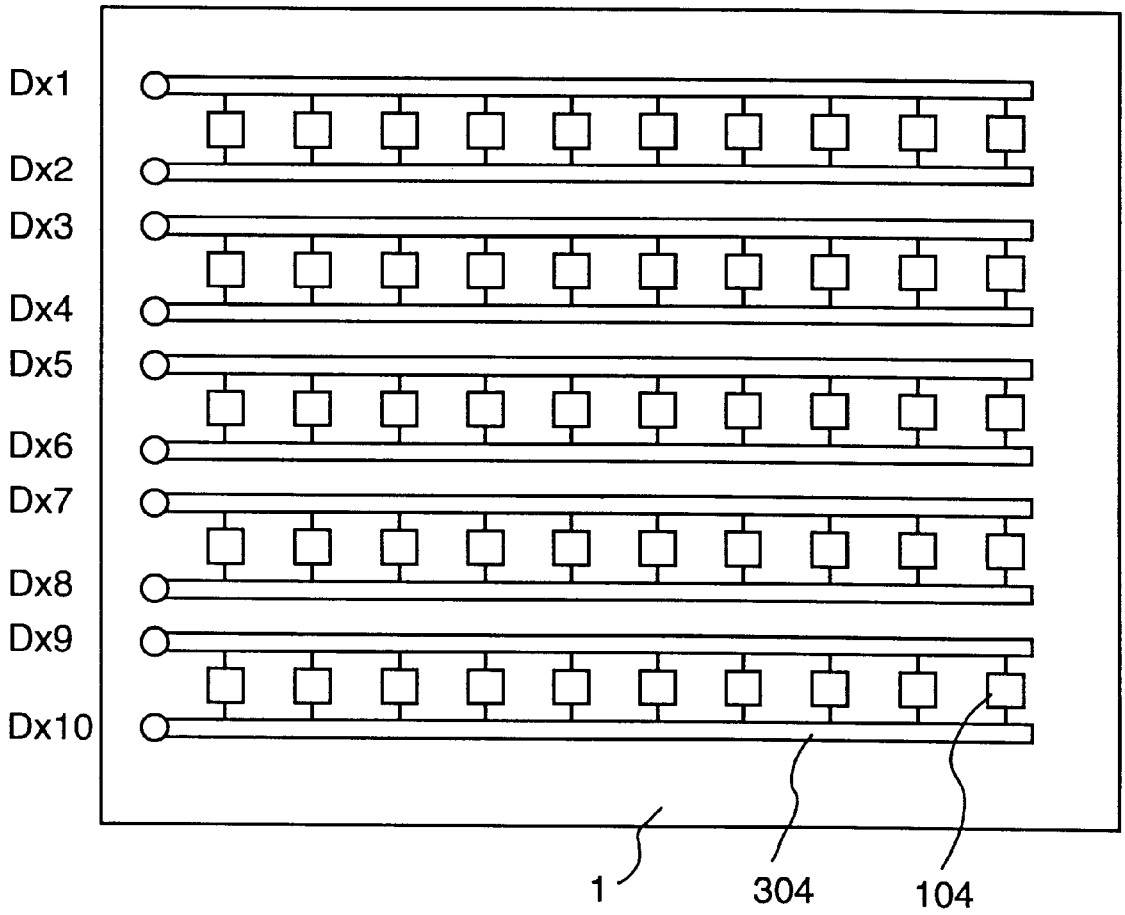
FIG. 12 is a plan view schematically showing an electron source with a ladder-shaped array.

Referring to FIG. 12, reference numeral 1 denotes the substrate; and 104, the surfaceconduction electron-emitting devices. Ten common wiring layers 304 for connecting the surfaceconduction electron-emitting devices 104 are arranged, which have external terminals Dx1 to Dx10, respectively.

The plurality of surfaceconduction electron-emitting devices 104 are parallelly arranged on the substrate 1, each of which is called a device row. A plurality of device rows are arranged to constitute the electron source.

The device row can be independently driven by applying appropriate voltages between the common wiring layers 304 of the device row (e.g., the common wiring layers 304 of the external terminals Dx9 and Dx10). More specifically, a voltage higher than the threshold voltage Vth is applied to the device row to enable electron emission, while a voltage equal to or lower than the threshold voltage Vth is applied to the device row to disable electron emission. Such a driving voltage can also be applied to the common wiring layers 304 of adjacent two of the terminals Dx2 to Dx9 located between the device rows, i.e., the common wiring layers 304 of the external terminals Dx2 and Dx3, Dx4 and Dx5, Dx6 and Dx7, or Dx8 and Dx9, respectively, while regarding these common wiring layers 304 as an integral wiring.

Figure 13:
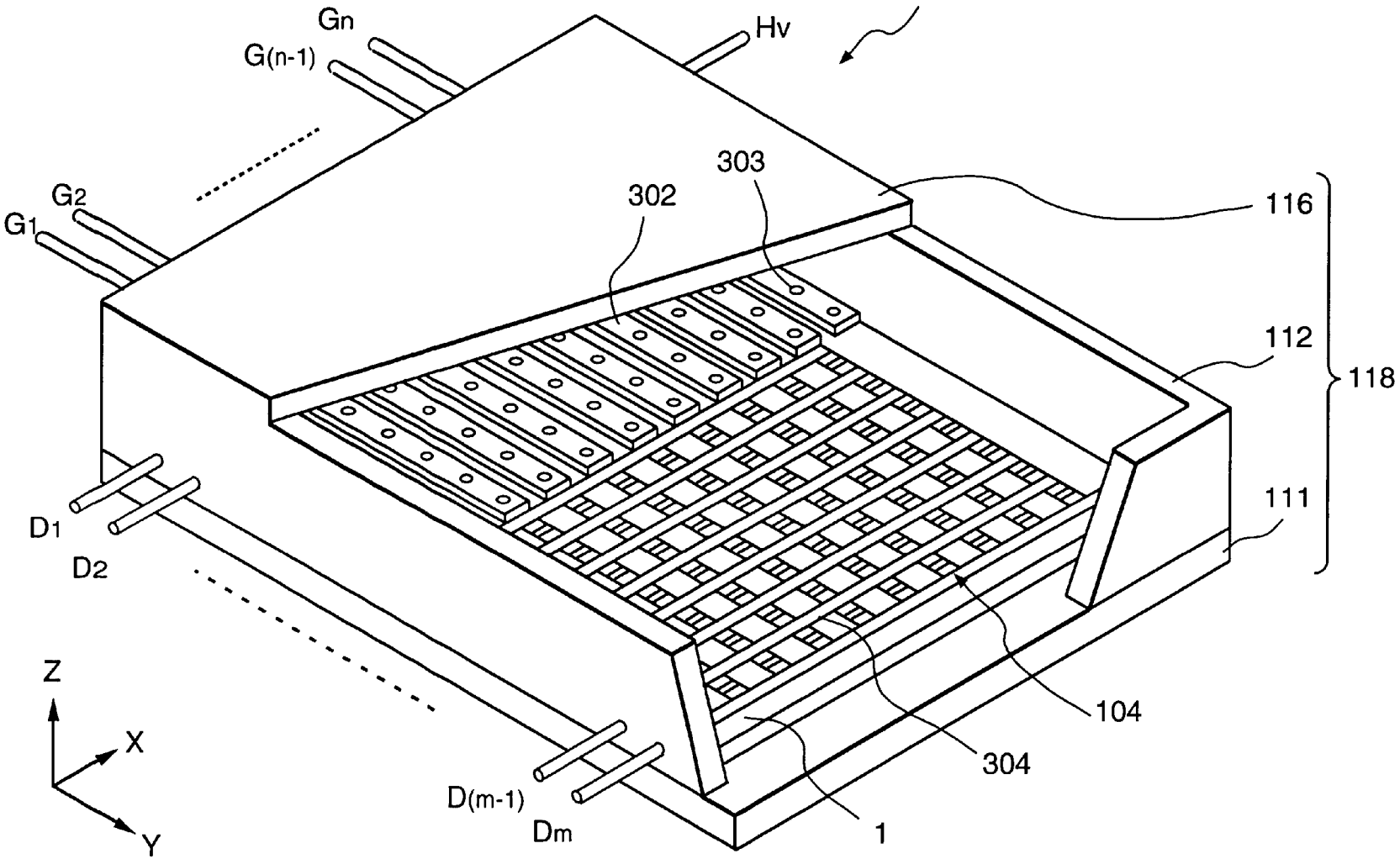
FIG. 13 is a perspective view schematically showing the arrangement of a display panel used in an image forming apparatus of the present invention using the electron sources with the ladder-shaped array.

FIG. 13 is a perspective view showing another example of the electron source of the present invention. FIG. 13 shows the arrangement of a display panel 301 having the electron source in a ladder-shaped array.

Referring to FIG. 13, reference numeral 302 denotes a grid electrode; and 303, an opening. Reference symbols D1 to Dm denote external terminals for applying voltages to the surfaceconduction electron-emitting devices; and G1 to Gn, external terminals connected to the grid electrode 302. The common wiring layers 304 between the device rows are formed on the substrate 1 as integral wiring.

The same reference numerals as in FIG. 9 denote the same members in FIG. 13. The display panel 301 largely differs from the display panel 201 using the electron source having a simple matrix arrangement and shown in FIG. 9 in that the grid electrode 302 is arranged between the substrate 1 and the face plate 116.

As described above, the grid electrode 302 is arranged between the substrate 1 and the face plate 116. The grid electrode 302 can modulate the electron beams output from the surfaceconduction electron-emitting devices 104 and has a structure in which the circular opening portions 303 are formed, in striped electrodes arranged to perpendicular to the device rows in the ladder-shaped array, in correspondence with the surfaceconduction electron-emitting devices 104 to allow electron beams to pass through.

The shape and arrangement position of the grid electrode 302 are not limited to those shown in FIG. 13. A lot of opening portions 303 may be formed in a mesh-like arrangement. In addition, the grid electrode 302 may be arranged in the periphery of or near the surfaceconduction electron-emitting devices 104.

The external terminals D1 to Dm and G1 to Gn are connected to a driving circuit (not shown). In synchronism with sequential driving (scanning) of the device rows one by one, a modulating signal of one line of image data is applied to the lines of the grid electrode 302. With this operation, electron beam irradiation on the phosphor film 114 is controlled so that the image can be displayed in units of lines.

As described above, the image forming apparatus of the present invention can be obtained using the electron source of the present invention, which can have any one of the simple matrix arrangement and the ladder-shaped array, so that an image forming apparatus suitable not only as a display apparatus for TV broadcasting but also as a display apparatus for a teleconference system or a computer can be achieved. In addition, the image forming apparatus of the present invention can be used as an exposure apparatus of an optical printer constituted by a photosensitive drum.

The present invention will be described below in more detail with reference to examples.

EXAMPLE 1

Figure 14:
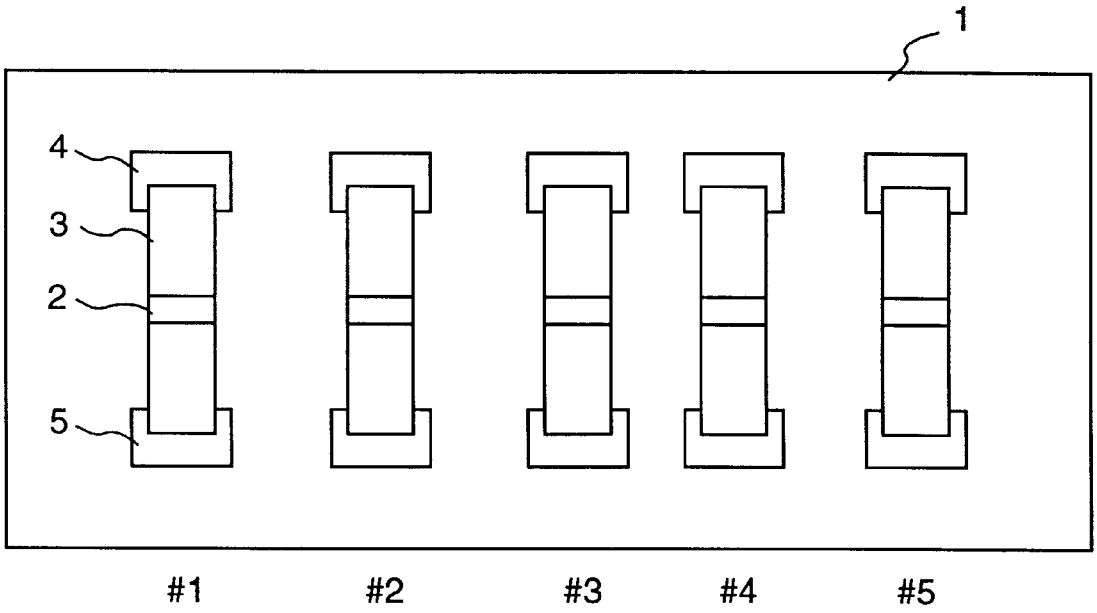
FIG. 14 is a plan view schematically showing an electron source of Example 1.

The arrangement of the surfaceconduction electron-emitting device used in this example is the same as shown in FIGS. 1A and 1B. In the electron source of this example, five surfaceconduction electron-emitting devices having the same shape are formed on the substrate 1. This arrangement is shown in FIG. 14. The same reference numerals as in FIGS. 1A and 1B denote the same members in FIG. 14.

The method of manufacturing the surfaceconduction electron-emitting device is basically the same as that described with reference to FIG. 2. The basic arrangement and manufacturing method of the surfaceconduction electron-emitting device used in this example will be described below with reference to FIGS. 1A, 1B, and 2.

Referring to FIGS. 1A and 1B, reference numeral 1 denotes a substrate; 4 and 5, device electrodes; 2, an electron emission portion; and 3, a thin film including an electron emission portion 2.

The manufacturing sequence will be described with reference to FIGS. 1A, 1B, and 2.

Step-a

The substrate 1 was prepared by forming a silicon oxide film having a thickness of 0.5 $\mu$m on a cleaned plate of soda-lime glass by sputtering, and a pattern having an opening conforming to a desired electrode shape was formed on the substrate 1 with a photoresist (RD-2000N-41, available from Hitachi Chemical., Ltd.). A Ti film having a thickness of 50 Å and an Ni film having a thickness of 1,000 Å were sequentially deposited on the substrate 1 by vacuum deposition. The photoresist pattern was dissolved with an organic solvent, and the Ni/Ti deposited film was lifted off, thereby forming the device electrodes 4 and 5 while setting a spacing L1 between the device electrodes to be 3 $\mu$m, and a width W1 to be 300 $\mu$m.

Step-b

To pattern the thin conductive film 3 for forming the electron emission portion 2 into a predetermined shape, a deposition mask which was popularly used was arranged on the device electrodes 4 and 5, and a Cr film having a thickness of 1,000 Å was deposited by vacuum deposition and patterned. Organic Pd (ccp4230, available from Okuno Seiyaku K.K.) was rotatably applied to the resultant structure with a spinner, and a heating and baking treatment was performed at 300° C. for 10 minutes. The thickness of the thin conductive film 3 formed in the above manner and comprising fine particles whose principal ingredient was Pd was 100 Å. The sheet resistance value was $2\times10^4$ Ω/□. The film of fine particles is a film consisting of the aggregate of a plurality of fine particles, as described above. As for the fine structure, the fine particles are not limited to dispersed particles. The film may also be a film comprising fine particles arranged to be adjacent to each other or overlap each other (an island structure is also included). The particle diameter means the diameter of a fine particle whose shape is recognizable in this state.

The Cr film and the baked thin film 3 were etched with an acid etchant to form a desired pattern.

With above processes, the device electrodes 4 and 5 and the thin conductive film 3 were formed on the substrate 1.

Step-c

Next, the substrate 1 on which the device electrodes 4 and 5 and the thin conductive film 3 were formed was set in the measuring/evaluating system. The measuring/evaluating system was evacuated by the vacuum pump to a vacuum of $2\times10^{-5}$ Torr. Thereafter, a voltage was applied across the device electrodes 4 and 5 from a power supply 51 for applying a device voltage Vf, thereby performing the electrification process (energization forming process). The waveform as shown in FIG. 4B was used as the voltage waveform for the energization forming process.

In FIG. 4B, T1 and T2 represent a pulse width and pulse interval of the voltage waveform. In this example, the pulse width T1 was set to be 1 msec, and the pulse interval T2 was set to be 10 msec. The peak value (the peak voltage at the time of the energization forming process) of the triangular wave was raised every step of 0.1 V to perform the energization forming process. During the energization forming process, a resistance measuring pulse was inserted in the pulse interval T2 at a voltage of 0.1 V, thereby measuring the resistance. When the resistance value measured with the resistance measuring pulse exceeded about 1 MΩ, the energization forming process was ended. At the same time, voltage application to the surfaceconduction electron-emitting devices was ended. For some surfaceconduction electron-emitting devices, a forming voltage VF was 5.0 V. For the remainings, the forming voltage VF was 5.1 V.

Step-d

A rectangular wave having a peak value of 14 V was applied to the surfaceconduction electron-emitting devices after the energization forming process to perform the activation process. The activation process was performed by applying the pulse voltage across the device electrodes 4 and 5 while measuring a device current If and an emission current Ie in the measuring/evaluating system shown in FIG. 5, as described above. At this time, the vacuum in the measuring/evaluating apparatus was $1.0\times10^{-5}$ Torr. The activation process was completed after about 20 minutes.

The surfaceconduction electron-emitting devices formed by the above-described steps were set in the measuring/evaluating system shown in FIG. 5. The system was evacuated using an ultra high-vacuum exhaust unit using no vacuum oil. The surfaceconduction electron-emitting devices were heated and baked at 120° C. for about 10 hours. After the partial pressure of the organic substance in the vacuum atmosphere was lowered to $10^{-7}$ Torr or less, the electron emission characteristics of all the surfaceconduction electron-emitting devices were measured.

The distance H between an anode electrode 54 shown in FIG. 5 and the surfaceconduction electron-emitting device was set to be 4 mm, the potential of the anode electrode 54 was set to be 1 kV, and the vacuum in the vacuum apparatus in measurement of the electron emission characteristics was set to be about $1\times10^{-6.5}$ Torr (the partial pressure of the organic substance: $1\times10^{-7.5}$ Torr or less). For the driving waveform pulse applied to the surfaceconduction electron-emitting device, the pulse width was set to be 100 μsec, and the peak value was set to be 14 V.

The voltage (peak value) and pulse width of the driving pulse in measurement equal the maximum voltage and maximum pulse width of a driving signal which is supplied in practical use of the surfaceconduction electron-emitting device.

A device serving as a reference was selected on the basis of the measurement result, and the characteristics of the remaining devices were corrected in accordance with the characteristics of the reference device.

As the reference device, a device which exhibited a highest electron emission threshold voltage Vth was selected. As has already been described above with reference to FIG. 7D or 7F, when a Vmax dependency or PWmax dependency is used, the characteristic curve can be shifted to the right side of the drawing. Therefore, only by selecting the device which exhibits the highest threshold voltage Vth as the reference device, the characteristics of the remaining devices can be shifted to the right side, so that the characteristics of all the devices can be uniform.

The device which exhibits the highest electron emission threshold voltage Vth exhibits the smallest emission current Ie when the voltage of 14 V is applied.

Table 1 shows the measurement result.

TABLE 1

| SCE No. | #1 | #2 | #3 | #4 | #5 |
|---|---|---|---|---|---|
| Ie (μA) | 0.9 | 0.9 | 0.9 | 0.9 | 1.0 |
| Vth (V) | 8.3 | 8.3 | 8.3 | 8.3 | 8.1 |

In Table 1, attention is paid to the emission currents of surfaceconduction electron-emitting devices #1 to #4. A pulse (correction waveform) having a peak value of 14 V or more was applied to a surfaceconduction electron-emitting device #5 such that the emission current amount of the surfaceconduction electron-emitting device #5 was corrected to equal those of the remaining surfaceconduction electron-emitting devices #1 to #4. The value Vmax was updated to change the device characteristics of the surfaceconduction electron-emitting device #5. More specifically, the peak value of the correction waveform was raised every step of 0.1 V with reference to 14 V. Every time the voltage was raised, a pulse having a peak value of 14 V and a width of 100 μsec, which corresponded to practical driving voltage, was applied to measure the characteristics of the surfaceconduction electron-emitting device #5. The peak value of the correction waveform was raised until the emission current of the surfaceconduction electron-emitting device #5 almost matched those of the remaining surfaceconduction electron-emitting devices #1 to #4, i.e., 0.9 μA. In this manner, the correction process for the surfaceconduction electron-emitting device #5 was performed.

As a result, when the peak value of the correction waveform was 14.3 V, the emission electron amount of the surfaceconduction electron-emitting device #5 almost equaled those of the remaining surfaceconduction electron-emitting devices #1 to #4, i.e., 0.9 μA, so that almost the same emission electron amounts could be obtained from all the surfaceconduction electron-emitting devices.

As described above, in the electron source of the present invention, the correction process is performed to apply a correction waveform different from the driving waveform to the surfaceconduction electron-emitting devices in advance. With this process, variations in device characteristics of the respective surfaceconduction electron-emitting devices can be eliminated. Therefore, an electron source having uniform electron emission characteristics can be obtained.

EXAMPLE 2

Five surfaceconduction electron-emitting devices were formed on a substrate following the same procedures as in Example 1, and the energization forming process, the activation process were performed to manufacture an electron source.

For this electron source, the electron emission characteristics were measured using the same measuring/evaluating system under the same conditions as in Example 1. Only one of the five surfaceconduction electron-emitting devices exhibited an emission current of 1.0 $\mu$A. The four remaining surfaceconduction electron-emitting devices exhibited emission currents of 0.9 $\mu$A. As in Example 1, each surfaceconduction electron-emitting device had an MI characteristic.

A pulse (correction waveform) having a pulse width of 100 $\mu$sec or more was applied to the surfaceconduction electron-emitting device which had exhibited the emission current of 1.0 $\mu$A to update a value PWmax, thereby changing the device characteristics. More specifically, the pulse width of the correction waveform was increased every step of 10 $\mu$sec with reference to 100 $\mu$sec. Every time the pulse width was increased, a pulse having a width of 100 $\mu$sec, which corresponded to practical driving voltage 14 V, was applied to measure the device characteristics. The pulse width of the correction waveform was increased until the emission current almost matched those of the remaining surfaceconduction electron-emitting devices, i.e., 0.9 $\mu$A, thereby performing the correction process for the surfaceconduction electron-emitting device. As a result, the emission current amounts of all the surfaceconduction electron-emitting devices were almost 0.9 $\mu$A, so that almost the same emission current amounts could be obtained from all the surfaceconduction electron-emitting devices.

As described above, in the electron source of the present invention, the correction process is performed to apply a correction waveform different from the driving waveform to the surfaceconduction electron-emitting devices in advance. With this process, variations in device characteristics of the respective surfaceconduction electron-emitting devices can be eliminated. Therefore, an electron source having uniform electron emission characteristics can be obtained.

EXAMPLE 3

In this example, an example of the image forming apparatus using an electron source constituted by arranging a large number of surfaceconduction electron-emitting devices in a simple matrix arrangement will be described.

Figure 15:
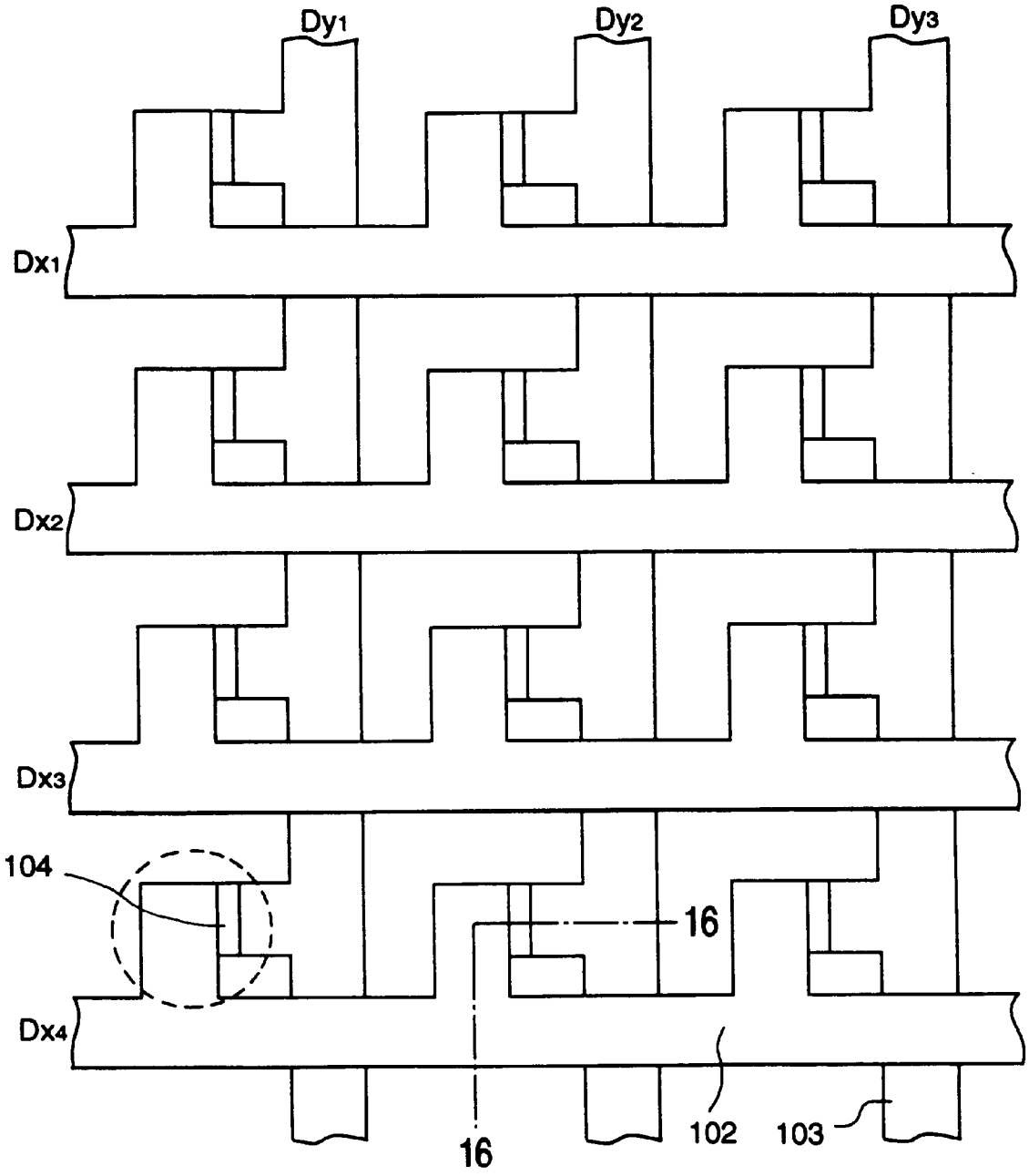
FIG. 15 is a plan view schematically showing an electron source of Example 4.
Figure 16:
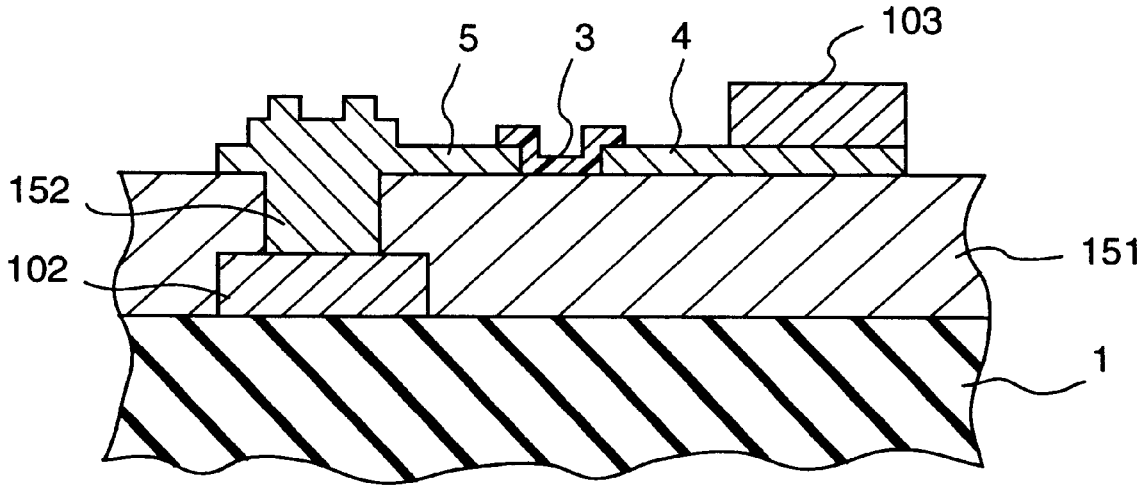
FIG. 16 is a cross-cross-sectional view taken along a line A-A' in FIG. 15.
Figure 17A:
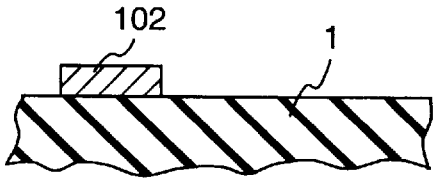
FIGS. 17A to 17H are cross-cross-sectional views showing the steps in manufacturing an electron source of Example 3.
Figure 17B:
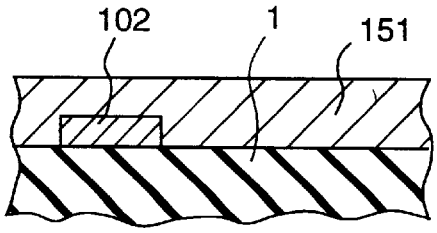
Figure 17C:
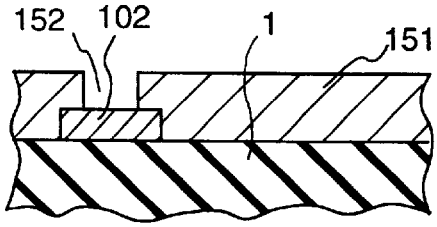
Figure 17D:
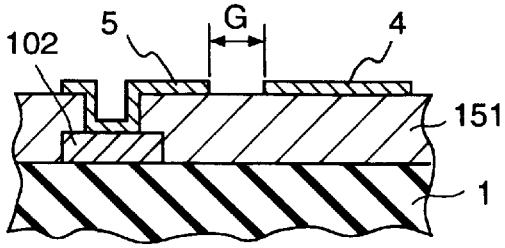
Figure 17E:
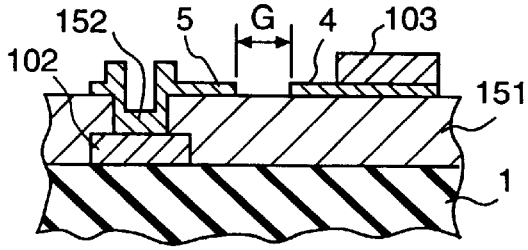
Figure 17F:
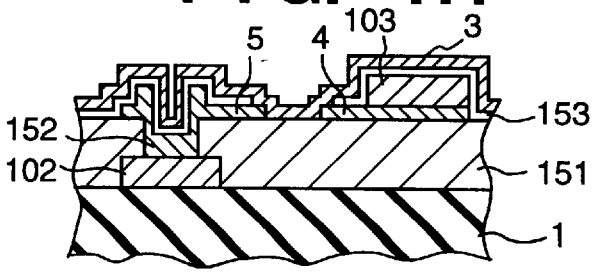
Figure 17G:
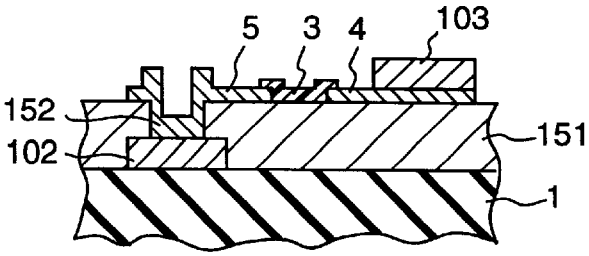
Figure 17H:
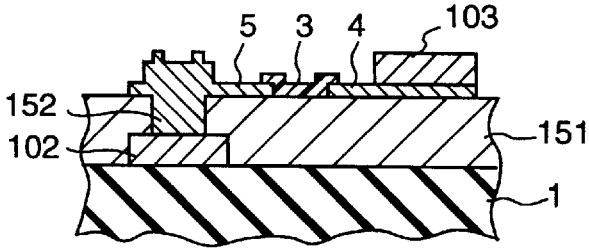

FIG. 15 is a plan view of part of the electron source. FIG. 16 is a cross-cross-sectional view taken along a line A-A' in FIG. 15. FIGS. 17A to 17H are cross-cross-sectional views showing the manufacturing steps. In FIGS. 15, 16, and 17A to 17H, the same reference numerals denote the same members.

Reference numeral 1 denotes a substrate; 102, an X-direction wiring layer (also to be referred to as a lower wiring layer); 103, a Y-direction wiring layer (also to be referred to as an upper wiring layer); 3, a thin film including an electron emission portion; 4 and 5, device electrodes; 151, an insulating interlayer; and 152, a contact hole for electrically connecting a device electrode 5 to the X-direction wiring layer 102.

The manufacturing method will be described below in detail in accordance with the sequence shown in FIGS. 17A to 17H. Steps a to h below correspond to FIGS. 17A to 17H, respectively.

Step-a

The substrate 1 was prepared by forming a silicon oxide film having a thickness of 0.5 $\mu$m on a cleaned plate of soda-lime glass by sputtering, and a Cr film having a thickness of 50 Å and an Au film having a thickness of 6,000 Å were sequentially deposited on the substrate 1 by vacuum deposition. Thereafter, a photoresist (AZ1370, available from Hoechst) was rotatably applied with a spinner, and the resultant structure was baked. The photomask image was exposed and developed to form the resist pattern of the lower wiring layer 102. The Au/Cr deposited film was wet-etched to form the lower wiring layer 102 having a desired shape.

Step-b

The insulating interlayer 151 consisting of a silicon oxide film having a thickness of 1.0 $\mu$m was deposited by RF sputtering.

Step-c

A photoresist pattern was formed on the silicon oxide film deposited in step-b to form the contact hole 152. The photoresist pattern was used as a mask to etch the insulating interlayer 151 and form the contact hole 152. Etching was performed by RIE (Reactive Ion Etching) using $CF_4$ and $H_2$ gases.

Step-d

A pattern for forming the device electrode 5 and a gap G between the device electrodes was formed with a photoresist (RD-2000N-41, available from Hitachi Chemical., Ltd.). A Ti film having a thickness of 50 Å and an Ni film having a thickness of 1,000 Å were sequentially deposited by vacuum deposition. The photoresist pattern was dissolved with an organic solvent. The Ni/Ti deposited film was lifted off to form the device electrodes 4 and 5 while setting a spacing L1 between the device electrodes to be 3 $\mu$m and a width W1 to be 300 $\mu$m.

Step-e

After a photoresist pattern for the upper wiring layer 103 was formed on the device electrodes 4 and 5, a Ti film having a thickness of 50 Å and an Au film having a thickness of 5,000 Å were sequentially deposited by vacuum deposition. An unnecessary portion was removed by lift-off to form the upper wiring layer 103 having a desired shape.

Step-f

Next, a Cr film 153 having a thickness of 1,000 Å was deposited by vacuum deposition and patterned. Organic Pd3 (ccp4230, available from Okuno Seiyaku K.K.) was rotatably applied to the resultant structure with a spinner, and a heating and baking treatment was performed at 300° C. for 10 minutes. The thickness of the thin film 3 formed in the above manner and comprising fine particles whose principal device was Pd was 100 Å. The sheet resistance value was $5\times10^4$ Ω/□. The film of fine particles is a film consisting of a plurality of fine particles, as described above. As for the fine structure, the fine particles are not limited to dispersed particles. The film may also be a film comprising fine particles arranged to be adjacent to each other or overlap each other (an island structure is also included). The particle diameter means the diameter of a fine particle whose shape is recognizable in this state.

Step-g

A Cr film 153 and the baked thin film 3 were etched with an acid etchant to form a desired pattern.

Step-h

A resist was applied to the resultant structure except for the contact hole 152 portion to form a pattern. A Ti film having a thickness of 50 Å and an Au film having a thickness of 5,000 Å were sequentially deposited by vacuum deposition. An unnecessary portion was removed by lift-off to bury the contact hole 152.

With the above processes, the lower wiring layer 102, the insulating interlayer 151, the upper wiring layer 103, the device electrodes 4 and 5, and the thin conductive film 3 were formed on the substrate 1.

An example of a display apparatus using the electron source manufactured in the above manner will be described below with reference to FIGS. 9, 10A, and 10B.

As described above, the substrate 1 on which a large number of surfaceconduction electron-emitting devices 104 were formed was fixed on a rear plate 111. A face plate 116 (constituted by forming a phosphor film 114 and a metal back 115 on the inner surface of a glass substrate 113) was arranged at a portion 5 mm above the substrate 1 through a supporting frame 112. Frit glass was applied to the junction portions between the face plate 116, the supporting frame 112, and the rear plate 111. The resultant structure was baked in the atmosphere or in a nitrogen environment at 400° C. to 500° C. for more than 10 minutes to effect sealing. The substrate 1 was also fixed to the rear plate 111 with frit glass.

Referring to FIG. 9, reference numerals 102 and 103 denote the X-direction wiring layers and the Y-direction wiring layers, respectively.

In the case of a monochromatic display, the phosphor film 114 consists of only a phosphor 122. In this example, however, the striped phosphors 122 (FIG. 10A) were employed. First, the black stripes were formed, and the phosphors 122 of the respective colors were applied to the gap portions between the black stripes to form the phosphor film 114. A material containing, as its principal component, popular graphite was used for the black stripes.

A slurry method was used as a method of applying the phosphors 122 to the glass substrate 113. The metal back 115 was formed on the inner surface side of the phosphor film 114. The metal back 115 was formed by performing a smoothing process (normally referred to as a "filming" process) for the inner side surface of the phosphor film 114 after the phosphor film 114 was manufactured, and then vacuum-depositing aluminum.

To increase the conductivity of the phosphor film 114, a transparent electrode (not shown) may be formed on the outer surface side of the phosphor film 114 of the face plate 116. In this example, however, the transparent electrode was omitted because a sufficient conductivity was obtained with only the metal back 115.

In the above-described sealing operation, sufficient positioning was performed because the phosphors 122 must be made to correspond to the surfaceconduction electron-emitting devices 104 in the case of a color display.

The glass vessel completed in the above manner was evacuated by a vacuum pump through an exhaust tube (not shown) to achieve a sufficient vacuum. Thereafter, a voltage was applied across the device electrodes 4 and 5 of the surfaceconduction electron-emitting devices 104 through the external terminals Dx1 to Dxm and Dy1 to Dyn to perform the energization forming process for the thin conductive films 3, thereby forming the electron emission portions 2.

The voltage waveform for the energization forming process was set to be the same as that shown in FIG. 4B. In this example, the pulse width T1 was set to be 1 msec, and the pulse interval T2 was set to be 10 msec. The energization forming process was performed in a vacuum atmosphere of about $1\times10^{-5}$ Torr.

In the electron emission portion 2 formed in this manner, fine particles whose principal ingredient was palladium were dispersed. The mean particle size of the fine particles was 30 Å.

The activation process was performed in a vacuum of $2\times10^{-5}$ Torr while measuring a device current If and an emission current Ie by applying a voltage having a peak value of 14 V and a pulse width of 30 $\mu$sec.

The energization forming process and the activation process were performed in this manner, so that the surfaceconduction electron-emitting device 104 having the electron emission portion 2 was manufactured.

Thereafter, the system was switched to an ultra high-vacuum exhaust apparatus using a pump system such as an ion pump which requires no oil, a baking treatment was performed at 120° C. for a sufficient period of time, and the exhaust process was performed. The vacuum after the baking treatment was about $1\times10_{-6.5}$ Torr. The partial pressure of the organic substance was about $1\times10^{-7.5}$ Torr.

An exhaust tube (not shown) was heated by a gas burner to weld the exhaust tube, thereby sealing the envelope. In addition, to maintain the vacuum after sealing, a getter treatment was performed by a high-frequency heating method.

The surfaceconduction electron-emitting devices 104 were driven with a driving voltage to check the electron emission characteristics of the surfaceconduction electron-emitting devices 104. By the same method as in Example 1, a correction waveform was applied to the surfaceconduction electron-emitting devices 104, so that the correction process of almost uniforming the electron emission characteristics of all the surfaceconduction electron-emitting devices 104 was performed. With this process, all the surfaceconduction electron-emitting devices 104 exhibited almost the same electron emission amounts with the same driving waveform, so that a uniform electron source was obtained.

In the image forming apparatus of the present invention, which was completed in the above manner, a scanning signal and a modulating signal were supplied to the surfaceconduction electron-emitting devices 104 from a signal generating means (not shown) through the external terminals Dx1 to Dxm and Dy1 to Dyn to cause electron emission. At the same time, a high voltage of several kV or more was applied to the metal back 115 or a transparent electrode (not shown) through a high-voltage terminal Hv to accelerate the electron beams, and the electrons were bombarded against the phosphor film 114. With this operation, excitation and light emission were caused, so that an image could be displayed.

In the image forming apparatus of the present invention, a very stable image could be obtained with a minimum luminance distribution. In addition, a display with a high contrast could be obtained while achieving excellent gradation and full-color display characteristics.

EXAMPLE 4

Five surfaceconduction electron-emitting devices were formed on a substrate following the same procedures as in Example 1. Thereafter, the energization forming process was performed using the same measuring/evaluating apparatus system as in the Example 1 such that a voltage waveform shown in FIG. 4A was applied across the device electrodes. At this time, the pulse width T1 in FIG. 4A was set to be 1 msec, the pulse interval T2 was set to be 10 msec, and the peak value of the triangular wave was set to be as constant as 14 V. Thereafter, an electron source was manufactured as in Example 1.

For the resultant electron source, the electron emission characteristics were measured using the same measuring/evaluating system under the same condition as in Example 1. Only one of the five surfaceconduction electron-emitting devices exhibited an emission current of 1.0 $\mu$A. The four remaining surfaceconduction electron-emitting devices exhibited emission currents of 0.9 $\mu$A. As in Example 1, each surfaceconduction electron-emitting device had an MI characteristic.

By the same method as in Example 1, a voltage pulse (correction waveform) having a peak value of 14 V or more was applied to the surfaceconduction electron-emitting device which exhibited the emission current of 1.0 $\mu$A, so that the correction process was performed to update a value Vmax and change the device characteristics. As a result, all the surfaceconduction electron-emitting devices exhibited almost the same electron emission amounts of about 0.9 $\mu$A, so that almost the same emission current amounts could be obtained from all the surfaceconduction electron-emitting devices.

EXAMPLE 5

Figure 18:
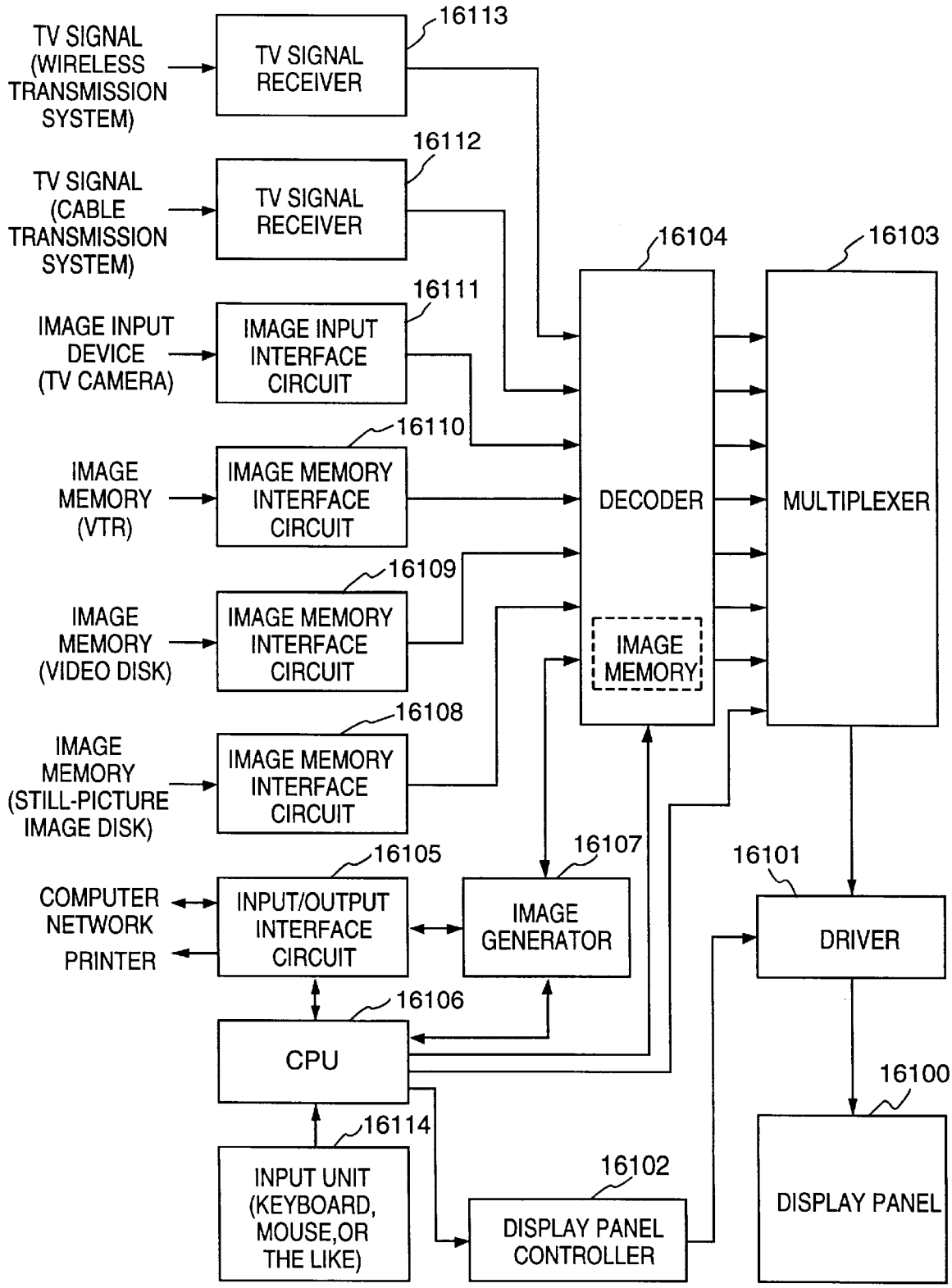
FIG. 18 is a block diagram showing an image forming apparatus of Example 5.

FIG. 18 is a block diagram showing an example of the image forming apparatus of the present invention, which can display image information supplied from various image information sources represented by TV broadcasting on a display panel using the above-described surfaceconduction electron-emitting devices as an electron source.

Referring to FIG. 18, reference numeral 16100 denotes a display panel; 16101, a driver of the display panel; 16102, a display controller; 16103, a multiplexer; 16104, a decoder; 16105, an input/output interface circuit; 16106, a CPU; 16107, an image generator; 16108 to 16110, image memory interface circuits; 16111, an image input interface circuit; 16112 and 16113, TV signal receivers; and 16114, an input unit.

When the image forming apparatus receives a signal such as a TV signal including both video information and audio information, video images and sound are reproduced simultaneously, as a matter of course. A description of circuits and speakers which are associated with reception, separation, processing, and storage of audio information will be omitted because these components are not directly related to the feature of the present invention.

The functions of the respective components will be described below in accordance with the flow of an image signal.

The TV signal receiver 16113 is a circuit for receiving TV signals transmitted via a wireless transmission system such as electric wave transmission or space optical communication.

The standards of the TV signals to be received are not particularly limited, and any one of the NTSC, PAL, and SECAM standards may be used. In addition, a TV signal comprising a larger number of scanning lines, i.e., so-called high-definition TV represented by the MUSE standard is a preferable signal source for utilizing the advantageous features of the display panel applicable to a large display screen and numerous pixels.

The TV signal received by the TV signal receiver 16113 is output to the decoder 16104.

The TV signal receiver 16112 is a circuit for receiving TV signals transmitted via a cable transmission system such as a coaxial cable system or an optical fiber system. Like the TV signal receiver 16113, the standards of the TV signals to be received are not particularly limited. The TV signal received by the TV signal receiver 16112 is also output to the decoder 16104.

The image input interface circuit 16111 is a circuit for receiving an image signal supplied from an image input device such as a TV camera or an image reading scanner. The received image signal is output to the decoder 16104.

The image memory interface circuit 16110 is a circuit for receiving an image signal stored in a video tape recorder (to be abbreviated to a VTR hereinafter). The received image signal is output to the decoder 16104.

The image memory interface circuit 16109 is a circuit for receiving an image signal stored in a video disk. The received image signal is output to the decoder 16104.

The image memory interface circuit 16108 is a circuit for receiving an image signal from a device such as a still-picture image disk which stores still-picture image data. The received still-picture image data is output to the decoder 16104.

The input/output interface circuit 16105 is a circuit for connecting the display apparatus to an external computer, a computer network, or an output device such as a printer. The input/output interface circuit 16105 not only inputs/outputs image data or character/graphic information but also can input/output control signals or numerical data between the CPU 16106 of the image forming apparatus and an external device, as needed.

The image generator 16107 is a circuit for generating display image data on the basis of image data or character/graphic information externally input through the input/output interface circuit 16105 or image data or character/graphic information output from the CPU 16106. The image generator 16107 incorporates circuits necessary for generating image data, including a reloadable memory for accumulating image data or character/graphic information, a read only memory which stores image patterns corresponding to character codes, and a processor for performing image processing.

The display image data generated by the image generator 16107 is output to the decoder 16104. However, the display image data can be output to an external computer network or a printer through the input/output interface circuit 16105, as needed.

The CPU 16106 mainly performs an operation associated with operation control of the display apparatus, and generation, selection, and editting of a display image.

For example, a control signal is output to the multiplexer 16103, thereby appropriately selecting or combining image signals to be displayed on the display panel. At this time, a control signal is generated to the display controller 16102 in accordance with the image signal to be displayed, thereby appropriately controlling the operation of the display apparatus, including the frame display frequency, the scanning method (e.g., interlaced scanning or non-interlaced scanning), and the number of scanning lines in one frame. In addition, the CPU 16106 directly outputs image data or character/graphic information to the image generator 16107, or accesses an external computer or memory through the input/output interface circuit 16105 to input image data or character/graphic information.

The CPU 16106 may operate for other purposes. For example, the CPU 16106 may be directly associated with a function of generating or processing information, like a personal computer or a wordprocessor. Alternatively, as described above, the CPU 16106 may be connected to an external computer network through the input/output interface circuit 16105 to cooperate with the external device in, e.g., numerical calculation.

The input unit 16114 is used by the user to input instructions, program, or data to the CPU 16106. In addition to a keyboard and a mouse, various input devices such as a joy stick, a bar-code reader, or a speech recognition device can be used.

The decoder 16104 is a circuit for reversely converting various image signals input from the circuits 16107 to 16113 into three primary color signals, or a luminance signal and I and Q signals. As indicated by a dotted line in FIG. 18, the decoder 16104 preferably incorporates an image memory such that TV signals such as MUSE signals which require an image memory for reverse conversion can be processed.

An image memory facilitates display of a still-picture image. In addition, the image memory enables facilitation of image processing including thinning, interpolation, enlargement, reduction, and synthesizing, and editing of image data in cooperation with the image generators 16107 and 16106.

The multiplexer 16103 appropriately selects a display image on the basis of a control signal input from the CPU 16106. More specifically, the multiplexer 16103 selects a desired image signal from the reverse-converted image signals input from the decoder 16104 and outputs the selected image signal to the driver 16101. In this case, the multiplexer 16103 can realize so-called multiwindow television, where the screen is divided into a plurality of areas to display a plurality of images in the respective areas, by selectively switching image signals within a display period for one frame.

The display controller 16102 is a circuit for controlling the operation of the driver 16101 on the basis of a control signal input from the CPU 16106.

For the basic operation of the display panel, the display controller 16102 outputs a signal for controlling the operation sequence of the driving power supply (not shown) of the display panel to the driver 16101. For the method of driving the display panel, the display controller 16102 outputs a signal for controlling the frame display frequency or the scanning method (e.g., interlaced scanning or non-interlaced scanning) to the driver 16101. The display controller 16102 outputs a control signal associated with adjustment of the image quality including the luminance, contrast, color tone, and sharpness of a display image to the driver 16101, as needed.

The driver 16101 is a circuit for generating a driving signal to be supplied to the display panel 16100. The display panel 16100 operates on the basis of an image signal input from the multiplexer 16103 and a control signal input from the display controller 16102.

The functions of the respective components have been described above. The image forming apparatus having the arrangement shown in FIG. 18 can display, on the display panel 16100, image information input from various image information sources. More specifically, various image signals including TV broadcasting signals are subjected to reverse conversion by the decoder 16104, appropriately selected by the multiplexer 16103, and input to the driver 16101. The display controller 16102 generates a control signal for controlling the operation of the driver 16101 in accordance with the image signal to be displayed. The driver 16101 supplies a driving signal to the display panel 16100 on the basis of the image signal and the control signal. With this operation, an image is displayed on the display panel 16100. The series of operations are integrally controlled by the CPU 16106.

This image forming apparatus not only displays image data selected from image information from the image memory incorporated in the decoder 16104 or the image generator 16107 but also can perform, for image information to be displayed, image processing including enlargement, reduction, rotation, movement, edge emphasis, thinning, interpolation, color conversion, and aspect ratio conversion, and image editing including synthesizing, deletion, combining, replacement, and insertion. Though not particularly referred to in the description of the present invention, circuits dedicated to processing and editing of audio information may be arranged, as for image processing and image editing.

The image forming apparatus can realize function of various devices, e.g., a TV broadcasting display device, a teleconference terminal device, an image editing device for still-pictures and moving pictures, an office-work terminal device such as a computer terminal or a wordprocessor, a game machine, and the like. Therefore, the image forming apparatus has a wide application range for industrial and private use.

FIG. 18 only shows an example of the arrangement of the image forming apparatus using the display panel in which surfaceconduction electron-emitting devices are used as an electron beam source, and the image forming apparatus of the present invention is not limited to this arrangement, as a matter of course.

For example, of the constituent elements shown in FIG. 18, circuits associated with functions unnecessary for the application purpose can be omitted. Reversely, constituent elements can be added in accordance with the application purpose. When this display apparatus is to be used as a visual telephone, preferably, a TV camera, a microphone, an illumination device, a transmission/reception circuit including a modem may be added.

Since this image forming apparatus uses, as its electron source, surfaceconduction electron-emitting devices, a low-profile display panel can be realized, so that the depth of the image forming apparatus can be reduced. In addition, since the display panel using surfaceconduction electron-emitting devices as the electron source can be easily enlarged, and it has a high luminance and a wide view angle and high uniformity, the image forming apparatus can display vivid images with realism and impressiveness.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron source having a plurality of surfaceconduction electron-emitting devices, comprising:

the step of forming a plurality of device electrode pairs on a substrate;

the step of forming a conductive thin film between device electrodes of each of said plurality of device electrode pairs;

the energization forming step of forming an electron emission portion on part of said conductive thin film by applying a voltage across said device electrode pair;

the evacuation step of lowering a partial pressure of an organic substance in a vacuum atmosphere to be not more than $1\times10^{-7}$ Torr; and the step of applying a characteristic correction voltage pulse across an arbitrary device electrode pair such that (emission current Ie vs. applied device voltage Vf) characteristics of said plurality of surfaceconduction electron-emitting devices are almost uniform.

2. The method according to claim 1, wherein the step of applying the characteristic correction voltage pulse includes the step of matching the (emission current Ie vs. applied device voltage Vf) characteristics of said devices with a reference corresponding to the (emission current Ie vs. applied device voltage Vf) characteristic of one of said plurality of surfaceconduction electron-emitting devices which exhibits a highest electron emission threshold voltage Vth.

3. The method according to claim 1, further comprising, between the energization forming step and the evacuation step, the electrification activation step of depositing carbon in a periphery of said electron emission portion formed in the energization forming step.

4. The method according to claim 1, wherein the characteristic correction voltage pulse has a peak value larger than that of a driving voltage pulse applied in practical use of said electron source.

5. The method according to claim 1, wherein the characteristic correction voltage pulse has a pulse width larger than that of a driving voltage pulse applied in practical use of said electron source.

6. The method according to claim 1, wherein the step of applying the characteristic correction voltage pulse includes the step of changing an electron emission threshold voltage Vth of one of said surfaceconduction electron-emitting devices, to which the pulse is applied, to a value larger than that before application of the pulse.

7. The method according to claim 1, further comprising, before the step of applying the characteristic correction voltage pulse, the measurement step of measuring variations in electron emission characteristics of said plurality of surfaceconduction electron-emitting devices.

8. The method according to claim 7, wherein the measurement step includes the step of applying, to a device, a voltage pulse having a peak value equal to a maximum peak value of a driving voltage pulse applied in practical use of said electron source, thereby measuring the emission current Ie.

9. The method according to claim 7, wherein the measurement step includes the step of applying, to a device, a voltage pulse having a pulse width equal to a maximum pulse width of a driving voltage pulse applied in practical use of said electron source, thereby measuring the emission current Ie.

10. A method of adjusting an electron source having a plurality of surfaceconduction electron-emitting devices, comprising:

the adjustment step of matching (emission current Ie vs. applied device voltage Vf) characteristics of said devices with a reference corresponding to the (emission current Ie vs. applied device voltage Vf) characteristic of one of said plurality of surfaceconduction electron-emitting devices which exhibits a highest electron emission threshold voltage Vth.

11. The method according to claim 10, wherein the adjustment step of matching the (emission current Ie vs. applied device voltage Vf) characteristics of said surfaceconduction electron-emitting devices with the reference includes the step of applying a characteristic correction pulse to said surfaceconduction electron-emitting devices in a vacuum atmosphere in which a partial pressure of an organic substance is lowered to be not more than $1\times10^{-7}$ Torr, thereby correcting the (emission current Ie vs. applied device voltage Vf) characteristics.

12. A method of adjusting an electron source having a plurality of surfaceconduction electron-emitting devices, comprising:

the step of applying a characteristic correction voltage pulse across an arbitrary device electrode pair in a vacuum atmosphere in which a partial pressure of an organic substance is not more than $1\times10^{-7}$ Torr such that (emission current Ie vs. applied device voltage Vf) characteristics of said surfaceconduction electron-emitting devices are almost uniform.

13. The method according to claim 12, wherein the characteristic correction voltage pulse has a peak value larger than that of a driving voltage pulse applied in practical use of said electron source.

14. The method according to claim 12, wherein the characteristic correction voltage pulse has a pulse width larger than that of a driving voltage pulse applied in practical use of said electron source.

15. The method according to claim 12, wherein the step of applying the characteristic correction voltage pulse includes the step of changing an electron emission threshold voltage Vth of one of said surfaceconduction electron-emitting devices, to which the pulse is applied, to a value larger than that before application of the pulse.

16. The method according to claim 12, further comprising, before the step of applying the characteristic correction voltage pulse, the measurement step of measuring variations in electron emission characteristics of said plurality of surfaceconduction electron-emitting devices.

17. The method according to claim 16, wherein the measurement step includes the step of applying, to a device, a voltage pulse having a peak value equal to a maximum peak value of a driving voltage pulse applied in practical use of said electron source, thereby measuring the emission current Ie.

18. The method according to claim 16, wherein the measurement step includes the step of applying, to a device, a voltage pulse having a pulse width equal to a maximum pulse width of a driving voltage pulse applied in practical use of said electron source, thereby measuring the emission current Ie.

19. A method of manufacturing an electron source having a plurality of surfaceconduction electron-emitting devices, comprising:

the step of forming a plurality of device electrode pairs on a substrate;

the step of forming a conductive thin film between device electrodes of each of said plurality of device electrode pairs;

the energization forming step of forming an electron emission portion on part of said conductive thin film by applying a voltage across said device electrode pair; and the step of matching (emission current Ie vs. applied device voltage Vf) characteristics of said devices with a reference corresponding to the (emission current Ie vs. applied device voltage Vf) characteristic of one of said plurality of surfaceconduction electron-emitting devices which exhibits a highest electron emission threshold voltage Vth.

20. A method of manufacturing an electron source having a plurality of electron-emitting devices, comprising the steps of:

forming a plurality of electron emitting portions on a substrate;

performing a first process by supplying a voltage to each of the plurality of electron emitting portions: and performing a second process by supplying a predetermined voltage to a part of the plurality of electron emitting portions after said first process;

wherein, in said second process step, the difference between the characteristics of the part of the plurality of electron emitting portions which are supplied with the predetermined voltage and the characteristics of reminder of the plurality of electron emitting portions which are not supplied with the predetermined voltage is corrected.

21. A method according to claim 20, wherein, in said first process, carbon or a carbonic compound is deposited near each of the electron emitting portions.

22. A method according to claim 20, wherein the electron emitting devices are arranged in a vacuum vessel, and said second process is performed, after further exhaust in the vacuum vessel after said first process has been completed.

23. A method according to claim 20, wherein said second process is performed under a condition in which a partial pressure of an organic substance is not more than $1\times10^{-7}$ Torr.

24. A method according to claim 20, wherein, in said second process, a pulse voltage is applied to the part of the plurality of electron emitting portions.

25. A method according to claim 20, wherein the characteristics of the electron emitting portions show electron emitting characteristics.

26. A method according to claim 20, wherein the characteristics of the electron emitting portions show a relationship between a voltage applied to the electron emitting portion and an amount of electrons emitted form the electron emitting portion which is applied the voltage.

27. A method according to claim 20, further comprising the step of measuring a characteristic of the electron emitting portion prior to said step of supplying the voltage to the part of the plurality of electron emitting portions.

28. A method of manufacturing an electron source having electron emitting portion, comprising the steps of:

forming the electron emitting portion on a substrate;

supplying a voltage to the electron emitting portion in a vacuum atmosphere;

further exhausting after said supplying step; and applying a voltage to the electron emitting portion after said further-exhausting step.

29. A method according to claim 28, wherein, in said applying step, the characteristic of the electron emitting portion is corrected.

30. A method according to claim 28, wherein the electron emitting portion shows an electron emitting characteristic.

31. A method according to claim 29, wherein the characteristic of the electron emitting portion shows a relationship between a voltage applied to the electron emitting portion and an amount of electrons emitted from the electron emitting portion which is applied the voltage.

32. A method according to claim 29, further comprising the step of measuring a characteristic of the electron emitting portion prior to said applying step.

33. A method according to claim 28, wherein said applying step is performed under a condition in which a partial pressure of an organic substance is not more than $1\times10^{-7}$ Torr.

34. A method according to claim 28, wherein, in said step of supplying a voltage, carbon or carbonic compound is deposited near the electron emitting portion.

35. A method according to claim 28, wherein, in said applying step, a pulse voltage is applied to the electron emitting portion.

36. A method of manufacturing an electron source having a plurality of electron-emitting devices, comprising the steps of:

forming a plurality of electron emitting portions on a substrate; and supplying a predetermined voltage to a part of the plurality of electron emitting portions under a condition in which a partial pressure of an organic substance is not more than $1\times10^{-7}$ Torr, after an activation process has completed;

wherein, in said supplying step, the difference between the characteristics of the part of the plurality of electron emitting portions which are supplied with the predetermined voltage and the characteristics of reminder of the plurality of electron emitting portions which are not supplied with the predetermined voltage is corrected.

37. A method according to claim 36, wherein, in said step of supplying the voltage to the part of the plurality of electron emitting portions, a pulse voltage is applied to the part of the plurality of electron emitting portions.

38. A method according to claim 36, wherein the characteristics of the electron emitting portions show electron emitting characteristics.

39. A method according to claim 36 wherein the characteristics of the electron emitting portions show a relationship between a voltage applied to the electron emitting portion and an amount of electrons emitted from the electron emitting portion which is applied the voltage.

40. A method according to claim 36, further comprising the step of measuring a characteristics of the electron emitting portion prior to said supplying the voltage to the part of the plurality of electron emitting portions.

41. A method of manufacturing an electron source having a plurality of electron-emitting devices, comprising the steps of:

forming a plurality of electron emitting portions on a substrate;

measuring a characteristic of the plurality of electron emitting portions; and supplying a predetermined voltage to a part of the plurality of electron emitting portions based on the measuring result in said measuring step, wherein, in said supplying step, the difference between the characteristics of the part of the plurality of electron emitting portions which are supplied with the predetermined voltage and the characteristics of reminder of the plurality of electron emitting portions which are not supplied with the predetermined voltage is corrected.

42. A method according to claim 41, wherein, in said step of supplying the voltage to the part of the plurality of electron emitting portions, a pulse voltage is applied to the part of the plurality of electron emitting portions.

43. A method according to claim 41, wherein the characteristics of the electron emitting portions show electron emitting characteristics.

44. A method according to claim 41, wherein the characteristics of the electron emitting portions show a relationship between a voltage applied to the electron emitting portion and an amount of electrons emitted from the electron emitting portion which is applied the voltage.

45. A method according to claim 28, wherein the electron emitting portion is a surfaceconduction electron emitting portion.

46. A method according to claim 36, wherein the electron-emitting devices are surfaceconduction electron-emitting devices.

47. A method according to claim 41, wherein the electron-emitting devices are surfaceconduction electron-emitting devices.

48. A method of manufacturing an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and wherein the voltage is supplied as a pulse voltage.

49. A method according to claim 48, wherein carbon is deposited on the electron-emitting portion before said supplying step.

50. A method of manufacturing an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and wherein said electron-emitting portion is an electron-emitting portion of a surface-conduction electron-emitting device.

51. A method of manufacturing an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and further comprising an electrifying activation step before said supplying step.

52. A method of manufacturing an electron source having an electron-emitting portion, comprising the step of:

forming an electron-emitting portion having carbon; and supplying a voltage to the electron-emitting portion after said forming step, wherein the voltage has a peak value larger than that of a driving voltage applied in practical use of said electron source, and wherein the voltage is supplied as a pulse voltage.

53. A method according to claim 52, wherein said forming step includes a step of depositing the carbon on the electron-emitting portion.

54. A method of manufacturing an electron source having an electron-emitting portion, comprising the step of:

forming an electron-emitting portion having carbon; and supplying a voltage to the electron-emitting portion after said forming step, wherein the voltage has a peak value larger than that of a driving voltage applied in practical use of said electron source, and wherein said electron-emitting portion is an electron-emitting portion of a surface-conduction electron-emitting device.

55. A method of manufacturing an electron source having an electron-emitting portion, comprising the step of:

supplying a voltage to the electron-emitting portion, wherein the voltage has a peak value larger than that of a driving voltage applied in practical use of the electron source, and wherein the voltage is supplied as a pulse voltage.

56. A method of manufacturing an electron source having an electron-emitting portion, comprising the step of:

supplying a voltage to the electron-emitting portion, wherein the voltage has a peak value larger than that of a driving voltage applied in practical use of the electron source, and wherein said electron-emitting portion is an electron-emitting portion of a surface-conduction electron-emitting device.

57. A method of manufacturing an electron source having an electron-emitting portion, comprising the step of:

supplying a voltage pulse to the electron-emitting portion in a condition in which a partial pressure of an organic substance is not more than $1\times10^{-7}$ Torr, wherein the voltage pulse has a pulse width larger than that of a driving voltage pulse applied in practical use of the electron source.

58. A method according to claim 57, wherein the electron-emitting portion is an electron-emitting portion of a surface-conduction electron-emitting device.

59. A method according to claim 57, wherein carbon is deposited on the electron-emitting portion before said supplying step.

60. A method according to claim 57, further comprising an electrifying activation step before said supplying step.

61. A method of manufacturing an electron source having an electron-emitting portion, comprising the steps of:

forming an electron-emitting portion having carbon; and supplying a voltage pulse to the electron-emitting portion after said forming step, wherein the voltage has a peak width larger than that of a driving voltage pulse applied in practical use of said electron source.

62. A method according to claim 61, wherein the electron-emitting portion is an electron-emitting portion of a surface-conduction electron-emitting device.

63. A method according to claim 61, wherein said forming step including a step of depositing the carbon on the electron-emitting portion.

64. A method of manufacturing an electron source having an electron-emitting portion, comprising the step of:

supplying a voltage pulse to the electron-emitting portion, wherein the voltage pulse has a pulse width larger than that of a driving voltage applied in practical use of the electron source.

65. A method according of claim 64, wherein the electron-emitting portion is an electron-emitting portion of a surface-conduction electron-emitting device.

66. A method of adjusting a characteristics of an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and wherein the voltage is supplied as a pulse voltage.

67. A method according to claim 66, wherein carbon is deposited on the electron-emitting portion before said supplying step.

68. A method of adjusting a characteristics of an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and wherein the electron-emitting portion is an electron-emitting portion of a surface-conduction electron-emitting device.

69. A method of adjusting a characteristics of an electron source having an electron-emitting portion, comprising the step of:

supplying a voltage to the electron-emitting portion in a condition in which a partial pressure of an organic substance is not more than $1\times10^{-7}$ Torr, wherein the voltage has a peak value larger than that of a driving voltage applied in practical use of said electron source, and further comprising an electrifying activation step before said supplying step.

70. A method of adjusting characteristics of an electron source having an electron-emitting portion, comprising the steps of:

forming an electron-emitting portion having carbon; and supplying a voltage to the electron-emitting portion after said forming step, wherein the voltage has a peak value larger than that of a driving voltage applied in practical use of the electron source, and wherein the voltage is supplied as pulse voltage.

71. A method of adjusting characteristics of an electron source having an electron-emitting portion, comprising the steps of:

forming an electron-emitting portion having carbon; and supplying a voltage to the electron-emitting portion after said forming step, wherein the voltage has a peak value larger than that of a driving voltage applied in practical use of the electron source, wherein the electron-emitting portion is an electron-emitting portion of a surface-conduction electron-emitting device.

72. A method according to claim 70, wherein said forming step includes a step of depositing the carbon on the electron-emitting portion.

73. A method of adjusting characteristics of an electron source having an electron-emitting portion, comprising the step of:

supplying a voltage to the electron-emitting portion, wherein the voltage has a peak value larger than that of a driving voltage applied in practical use of the electron source wherein the voltage is supplied as a pulse voltage.

74. A method of adjusting characteristics of an electron source having an electron-emitting portion, comprising the step of:

supplying a voltage to the electron-emitting portion, wherein the voltage has a peak value larger than that of a driving voltage applied in practical use of the electron source wherein the electron-emitting portion is an electron-emitting portion of a surface-conduction electron-emitting device.

75. A method of adjusting characteristics of an electron source having an electron-emitting portion, comprising the step of:

supplying a voltage pulse to the electron-emitting portion in a condition in which a partial pressure of an organic substance is not more than $1\times10^{-7}$ Torr, wherein the voltage pulse has a pulse width larger than that of a driving voltage pulse applied in practical use of the electron source.

76. A method according to claim 75, wherein the electron-emitting portion is an electron-emitting portion of a surface-conduction electron-emitting device.

77. A method according to claim 75, wherein carbon is deposited on the electron-emitting portion before said supplying step.

78. A method according to claim 75, further comprising an electrifying activation step before said supplying step.

79. A method of adjusting characteristics of an electron source having an electron-emitting portion, comprising the steps of:

forming an electron-emitting portion having carbon; and supplying a voltage pulse to the electron-emitting portion after said forming step, wherein the voltage pulse has a pulse width larger than that of a driving voltage pulse applied in practical use of the electron source.

80. A method according to claim 79, wherein the electron-emitting portion is an electron-emitting portion of a surface-conduction electron-emitting device.

81. A method according to claim 79, wherein said forming step including a step of depositing the carbon on the electron-emitting portion.

82. A method of adjusting characteristics of an electron source having an electron-emitting portion, comprising the step of:

supplying a voltage pulse to the electron-emitting portion, wherein the voltage pulse has a pulse width larger than that of a driving voltage applied in practical use of the electron source.

83. A method according to claim 82, wherein the electron-emitting portion is an electron-emitting portion of a surface-conduction electron-emitting device.

* * * * *

UNITED STATES PATENT AND TRADEMARK OFFICE

CERTIFICATE OF CORRECTION

PATENT NO. : 6,231,412 B1
DATED : May 15, 2001
INVENTOR(S) : Hisaaki Kawade et al.

It is certified that error appears in the above-identified patent and that said Letters Patent is hereby corrected as shown below:

Title page,
Item [56], References Cited, FOREIGN PATENT DOCUMENTS:
"6431332" should read -- 64-31332 --; and Item [57], ABSTRACT,
Line 1, "surfaceconduction" should read -- surface conduction --;
Line 3, "surfaceconduction" should read -- surface conduction --; and "made," should read -- made --;
Line 4, "controllable," should read -- controllable --; and
Line 5, "surfaceconduction" should read -- surface conduction --.

Column 23,
Line 40, "remainings," should read -- remainder, --.

Column 32,
Line 57, "surfaceconduction" should read -- surface conduction --.

Column 33,
Line 7, "surfaceconduction" should read -- surface conduction --;
Line 15, "surfaceconduction" should read -- surface conduction --;
Line 34, "surfaceconduction" should read -- surface conduction --;
Line 41, "surfaceconduction" should read -- surface conduction --;
Line 55, "surfaceconduction" should read -- surface conduction --;
Line 61, "surfaceconduction" should read -- surface conduction --.

Column 34,
Line 2, "surfaceconduction" should read -- surface conduction --;
Line 8, "surfaceconduction" should read -- surface conduction --;
Line 15, "surfaceconduction" should read -- surface conduction --;
Line 28, "surfaceconduction" should read -- surface conduction --;
Line 35, "surfaceconduction" should read -- surface conduction --;
Line 49, "surfaceconduction" should read -- surface conduction --; and
Line 65, "surfaceconduction" should read -- surface conduction --.

Column 35,
Line 14, "reminder" should read -- the remainder --; and
Line 36, "form" should read -- from --.

UNITED STATES PATENT AND TRADEMARK OFFICE

CERTIFICATE OF CORRECTION

PATENT NO. : 6,231,412 B1
DATED : May 15, 2001
INVENTOR(S) : Hisaaki Kawade et al.

It is certified that error appears in the above-identified patent and that said Letters Patent is hereby corrected as shown below:

Column 36,
Line 16, "completed;" should read -- been completed; --;
Line 20, "reminder" should read -- the remainder --;
Line 21, "are" should read -- is --;
Line 30, "claim 36" should read -- claim 36, --; and
Line 36, "a" should be deleted.

Column 37,
Line 2, "surfaceconduction" should read -- surface conduction --;
Line 5, "surfaceconduction" should read -- surface conduction --; and
Line 8, "surfaceconduction" should read -- surface conduction --.

Column 38,
Line 29, "voltage" should read -- voltage pulse --;
Line 36, "including" should read -- includes --;
Line 44, "of" should read -- to --;
Line 48, "a" should be deleted; and
Line 60, "a" should be deleted.

Column 39,
Line 4, "a" should be deleted; and
Line 22, "pulse" should read -- a pulse --.

Signed and Sealed this

Twenty-sixth Day of March, 2002

*Attest:*

*Attesting Officer*

JAMES E. ROGAN
*Director of the United States Patent and Trademark Office*